US007648386B2

(12) United States Patent
Suzuki et al.

(10) Patent No.: US 7,648,386 B2
(45) Date of Patent: Jan. 19, 2010

(54) MINIATURIZED CONNECTOR FOR FLEXIBLE PRINTED CIRCUIT BOARD

(75) Inventors: Masayuki Suzuki, Shinagawa-Ku (JP); Jun-ichi Watanabe, Shinagawa-Ku (JP)

(73) Assignee: DDK, Ltd., Tokyo (JP)

( * ) Notice: Subject to any disclaimer, the term of this patent is extended or adjusted under 35 U.S.C. 154(b) by 0 days.

(21) Appl. No.: 11/932,004

(22) Filed: Oct. 31, 2007

(65) Prior Publication Data

US 2008/0064255 A1 Mar. 13, 2008

Related U.S. Application Data

(60) Continuation of application No. 11/557,417, filed on Nov. 7, 2006, now Pat. No. 7,393,239, which is a division of application No. 11/327,901, filed on Jan. 9, 2006, now abandoned, which is a division of application No. 10/417,773, filed on Apr. 17, 2003, now Pat. No. 7,044,773.

(30) Foreign Application Priority Data

| | | |
|---|---|---|
| Aug. 1, 2002 | (JP) | 2002-224340 |
| Nov. 27, 2002 | (JP) | 2002-343398 |
| Nov. 27, 2002 | (JP) | 2002-343403 |
| Dec. 25, 2002 | (JP) | 2002-373403 |
| Dec. 25, 2002 | (JP) | 2002-373404 |
| Jan. 8, 2003 | (JP) | 2003-001863 |

(51) Int. Cl.
*H01R 13/15* (2006.01)

(52) U.S. Cl. ..... 439/495

(58) Field of Classification Search ..... 439/495, 439/260

See application file for complete search history.

(56) References Cited

U.S. PATENT DOCUMENTS

| | | | |
|---|---|---|---|
| 6,726,497 B2 | 4/2004 | Nogawa et al. | |
| 6,767,233 B2 | 7/2004 | Tsunematsu | |
| 6,935,888 B2 | 8/2005 | Huang | |
| 7,052,300 B2 | 5/2006 | Okita et al. | |
| 7,112,079 B2 | 9/2006 | Miura et al. | |
| 7,223,110 B2 * | 5/2007 | Suzuki et al. | 439/260 |
| 7,261,589 B2 | 8/2007 | Gillespie et al. | |

FOREIGN PATENT DOCUMENTS

| | | |
|---|---|---|
| JP | 59-086679 | 5/1984 |

(Continued)

*Primary Examiner*—Neil Abrams
(74) *Attorney, Agent, or Firm*—Baker Botts L.L.P.

(57) ABSTRACT

A connector includes contacts each having a contact portion, an elastic portion and a fulcrum portion between the contact portion and a connection portion, and a pressure receiving portion; a housing fixing the contacts; and a slider having urging portions pivotally moved between the connection and pressure receiving portions of the contacts to urging the contact portions against the circuit board, thereby achieving reliable connection and miniaturization of the connector. In an aspect, the housing is formed on the side of a board insertion opening with a recessed portion for conducting the board. In another aspect, the contact includes upper and lower contact portions one above the other arranged alternately staggered so as to be connected to a circuit board having contact portions alternately staggered, so that no defective connection occurs, even if the circuit board is inserted erroneously upside down. In a further aspect, the connector further includes locking members having an engaging portion which engages an anchoring portion of the circuit board to prevent the circuit board from being removed. In one aspect, contacts of two kinds are inserted into the housing from opposite sides, respectively so that these contacts of the two kinds are into contact with the contact portions on respective surfaces of the circuit board. In a further aspect, moreover, a plate-shaped piece is provided in opposition to the contact portions of the contacts to prevent the housing from being deformed.

12 Claims, 26 Drawing Sheets

FOREIGN PATENT DOCUMENTS

| | | |
|---|---|---|
| JP | 60-57083 | 4/1985 |
| JP | H3-8886 | 1/1991 |
| JP | H3-103578 | 10/1991 |
| JP | 5-182723 | 7/1993 |
| JP | 05217642 | 8/1993 |
| JP | H5-84071 | 11/1993 |
| JP | 06-086289 | 3/1994 |
| JP | 06-176826 | 6/1994 |
| JP | 7-16381 | 1/1995 |
| JP | 7-16385 | 1/1995 |
| JP | 8-180940 | 7/1996 |
| JP | 8-250212 | 9/1996 |
| JP | 3035692 | 1/1997 |
| JP | 09171858 | 6/1997 |
| JP | 09-199241 | 7/1997 |
| JP | 10125415 | 5/1998 |
| JP | 10208810 | 8/1998 |
| JP | 11-031561 | 2/1999 |
| JP | 11054220 | 2/1999 |
| JP | 11307198 | 11/1999 |
| JP | 2000-021478 | 1/2000 |
| JP | 2000-030784 | 1/2000 |
| JP | 2000-106238 | 4/2000 |
| JP | 2000-299168 | 10/2000 |
| JP | 2001-076794 | 3/2001 |
| JP | 2001-110483 | 4/2001 |
| JP | 2001-307804 | 11/2001 |
| JP | 2001-307805 | 11/2001 |
| JP | 2001345136 | 12/2001 |
| JP | 2001357918 | 12/2001 |
| JP | 2002015800 | 1/2002 |
| JP | 2002-042980 | 2/2002 |
| JP | 2002042939 | 2/2002 |
| JP | 02-073081 | 3/2002 |
| JP | 2002-093526 | 3/2002 |
| JP | 2002134194 | 5/2002 |
| JP | 2002190360 | 5/2002 |
| JP | 2002-184494 | 6/2002 |
| JP | 2002-270290 | 9/2002 |
| JP | 2003-151662 | 5/2003 |
| JP | 2004-071160 | 3/2004 |
| JP | 2004-178958 | 6/2004 |
| JP | 2004-178959 | 6/2004 |
| JP | 2004-206987 | 7/2004 |
| JP | 2004-214124 | 7/2004 |
| JP | 05-069882 | 3/2005 |
| JP | 06-082783 | 3/2006 |
| WO | WO8807271 | 9/1988 |

* cited by examiner

MINIATURIZED CONNECTOR FOR FLEXIBLE PRINTED CIRCUIT BOARD

CROSS-REFERENCE TO RELATED APPLICATIONS

This application is a continuation of U.S. patent Ser. No. 11/557,417, filed Nov. 7, 2006, now U.S. Pat. No. 7,393,239, which is a divisional of U.S. patent application Ser. No. 11/327,901, filed Jan. 9, 2006, now abandoned, which is a divisional of U.S. patent application Ser. No. 10/417,773, filed Apr. 17, 2003, now U.S. Pat. No. 7,044,773, which claims priority to Japanese Patent Application No. 2002-224,340, filed Aug. 1, 2002, Japanese Patent Application No. 2002-343,398, filed Nov. 27, 2002, Japanese Patent Application No. 2002-343,403, filed Nov. 27, 2002, Japanese Patent Application No. 2002-373,403, filed Dec. 25, 2002, Japanese Patent Application No. 2002-373,404, filed Dec. 25, 2002, and Japanese Patent Application No. 2003-1,863, filed Jan. 8, 2003, each of which are incorporated by reference in their entireties herein, and from which priority is claimed.

BACKGROUND OF THE INVENTION

The present invention relates to a connector for use in a mobile phone or cellular phone, notebook personal computer, digital camera or the like, and more particularly to a connector capable of reliably urging contacts against a flexible printed circuit board or flexible flat cable, facilitating conducting the circuit board or flat cable into the connector and at the same time achieving miniaturization of the connector, eliminating any defective connection even if the circuit board is inserted into the connector erroneously upside down, reliably locking the board or cable to the connector, miniaturizing the connector even in the case of the circuit board having contacts on both surfaces, and reinforcing the connector preparatory to mounting it onto the board or cable.

In general, connectors for use in mobile phones, charge coupled device (CCD) cameras and the like are much thinner (so-called lighter and more compact connectors) and include contacts arranged in extremely narrow pitches. These connectors are used with both the flexible printed circuit boards and flexible flat cables or used exclusively to flexible printed circuit boards. These connectors have a construction that by inserting a circuit board or flat cable into an insertion opening of its housing, the circuit board or flat cable is brought into contact with contact portions of the contacts.

These connectors are roughly classified into two kinds. The connectors of one kind mainly comprise a housing and contacts, and when a flexible printed circuit board is inserted into the housing, it is brought into contact with contact portions of the contacts. This type of connectors is so-called "non-zero-insertion force" (NZIF) type. The connectors of the other kind mainly comprise a housing, contacts and a slider so that a flexible printed circuit board is embraced by the housing and the slider. The connectors of this type are further divided into two kinds, that is, so-called "zero-insertion force" (ZIF) type and "piano touch" type. There are various methods for holding the flexible printed circuit board by the housing and the slider. In many cases, however, after a flexible printed circuit board has been inserted into the housing, the slider is inserted into the housing to urge the circuit board against contacts. The "zero-insertion force" type is disclosed in the patent literature 1, and the "piano touch" type is in the patent literature 2 described below.

The connector of "non-zero-insertion force" type has a construction in that a flexible printed circuit board is inserted through the insertion opening into the housing to force the board into contact with contact portions of the contacts without using a slider, thereby accomplishing the connection of the circuit board. The flexible printed circuit board is subjected to pressure when being inserted into the housing. When the flexible printed circuit board is caused to contact the contact portions, the contact portions are sometimes intentionally curved or bent in order to facilitate their contacting, or the contact portions of the contacts are often provided in symmetry across the board to embrace it by the contact portions.

The housing is formed with a required number of insertion grooves for inserting the contacts therein and an insertion opening for inserting the flexible printed circuit board. The contacts each mainly comprise a contact portion adapted to contact a flexible printed circuit board or the like, a connection portion to be connected to a board, and a fixed portion to be fixed to the housing. These contacts are fixed to the housing as by press-fitting. FIGS. 30A and 30B illustrate a contact 64 of the "zero-insertion force" type connector. This contact 64 is substantially in the form of a U-shape and mainly composed of a contact portion 22 adapted to contact a flexible printed circuit board 40 or flexible flat cable, a connection portion 24 to be connected to a board or substrate, and a fixed portion 42 to be fixed to the housing 62 as by press-fitting.

As shown in FIGS. 30A and 30B, a slider 66 of the "zero-insertion force" type is substantially in the form of a wedge. The slider 66 is inserted into the housing 62 having the required number of the contacts 64 arranged therein, after the flexible printed circuit board 40 or flexible flat cable has been inserted into the housing 62. Such a slider 66 mainly comprises a mounting portion 74 to be mounted on the housing 62, and an urging portion 68 for urging the flexible printed circuit board 40 or flexible flat cable against the contact portions 22 of the contacts 64. Prior to the insertion of the flexible printed circuit board 40 or flexible flat cable, the slider 66 is temporarily inserted in the housing 62 for the purpose of storage as shown in FIG. 30A. After the circuit board 40 or cable has been inserted, the slider 66 is again inserted into the housing 62 so that the urging portion 68 of the slider 66 is inserted in the direction in parallel with the circuit board 40 or cable as shown in FIG. 30B, whereby the board 40 or cable is urged against the contact portions 22 of the contacts 64.

In order to accommodate a customer's specification, minimize pitches of contacts, or miniaturize a connector, it is sometimes required to arrange connection portions of contacts on the side of the insertion opening of the housing (or to arrange the contacts alternately staggered).

Moreover, the patent literature 3 described below discloses a construction for locking a flexible printed circuit board. The patent literature 4 discloses a connector for a circuit board with a view to improving productivity by reliable connection without positional shifting of circuit board even if the circuit board has particularly miniaturized terminals or terminals arranged in minimum pitches for signal inputs and outputs.

Patent Literature 1

Japanese Utility Model Application Opened No. H6-60,983 discloses one example of connectors of the "zero-insertion force" type. As can be seen from the "Abstract" of the Japanese Utility Model, this invention relates to a connector with a slider for a print board for use in a narrow space in an electronic or communication appliance. The slider is formed at ends on both sides with U-shaped arms with their proximal ends fixed to the slider as guiding means when being inserted into a housing. The U-shaped arms are each provided on its opening side with a projection and formed with a notch such that the opening end is visible from the inserting side. The housing is provided at both the ends with projections having an oblique surface adapted to engage the projection of the slider.

When the slider together with connection terminals of a flexible printed circuit board is inserted into the housing, the projections of the slider ride over the projections having the oblique surface of the housing so that the opening ends of the U-shaped arms of the slider are temporarily spread outwardly and then returned to their normal positions when the insertion has been completed.

Patent Literature 2

Japanese Patent Application Opened No. H13-257,020 discloses one example of the so-called "piano touch" type connector. With a view to obtaining an accurate positioning of a flexible printed circuit board relative to contacts of the disclosed connector, projections are provided in a row on a line on a terminal block between the contacts. After a flexible printed circuit board or flat cable has been inserted into the terminal block, a slider is moved to urge the circuit board or flat cable against the contacts. At the moment when the circuit board or flat cable is electrically connected to the contacts by the slider in this manner, the projections snap into recesses between patterns of the circuit board or flat cable, thereby ensuring positional coincidence between the contacts and patterns of the circuit board or flat cable.

Patent Literature 3

Japanese Utility Model Application Opened No. H6-82, 783 discloses a construction of a connector for locking a flexible flat cable. With a view to causing a flat cable to easily engage jaws of a slider even if the flat cable having on its rear surface a rigid reinforcing plate, the disclosed connector includes a housing provided therein contact pins and forming fitting space therein for receiving a flat cable, and a slider removably provided in the space of housing and pivotally movable out of the housing when the slider is removed therefrom. After the flat cable has been inserted into the fitting space in the housing, the slider is forced into the fitting space to cause the flat cable to be electrically connected to the contact pins. The slider is provided with anchoring projections on its surface against which the flat cable abuts. The anchoring projections of the slider are inserted in and engaged with anchoring portions formed in the flexible flat cable and a reinforcing plate provided on its rear surface.

Patent Literature 4

Japanese Patent Application Opened No. H5-326,084 discloses a connector for a circuit board. According to the description in the "Abstract" of the Japanese Patent, the connector accomplishes reliable connection to improve productivity without any positional shifting even if the circuit board having signal input-output terminals arranged with minimum pitches and the terminals themselves being miniaturized. A circuit board includes a plurality of signal input-output terminals arranged in rows at an edge of the circuit board. The connector includes jack terminal contacts arranged at corresponding locations to the signal input-output terminals of the circuit board. After the circuit board has been inserted through an opening on the side of the terminal contacts into the connector, the circuit board is urged and moved toward the contacts of the jack terminals so that the signal input-output terminals are brought into contact with the corresponding contacts of the connector. The connector further comprises positioning means arranged in the region where the insulator circuit board is inserted. When the circuit board is inserted into a predetermined position, the positioning means will position the circuit board thereat.

In recent years, with miniaturization of electrical and electronic appliances, the connectors of this kinds have been strongly required to be more miniaturized. Recently, moreover, there has been increasingly a need for connectors having a small number of connection lines such as 4 to 10 depending upon customer's specifications. On the other hand, it is better to be able to insert a circuit board into a connector with a slight force, while it is better to be able to hold the circuit board in the connector with a sufficiently strong force. The insertion and holding forces are incompatible with each other in this manner and therefore give rise to the following problems.

First, in the connector of the prior art shown in FIGS. 30A and 30B, there are six layers in height, that is, the upper and lower walls of the housing 62, the contact portion 22 and the pressure receiving portion 70 of each of the contacts 64, the urging portion 68 of the slider 66 and the flexible printed circuit board 40 or flexible flat cable. In order to reduce the connector's height as much as possible, it is possible to omit the pressure receiving portion 70 of each of the contacts to obtain five layers in height. It is however impossible to more reduce the height of the connector in consideration of strength of the respective members and specifications or customer's demands.

With the connector 60 shown in FIGS. 30A and 30B, the insertion of the circuit board 40 or flat cable and urging of the contact portions 22 of the contacts 64 against the circuit board or flat cable take place only on the side of the insertion opening of the housing, so that as the connector is miniaturized, such operations would become more difficult. In the case that extremely narrow pitches of contacts are required, moreover, the insertion of contacts into a connector from only one direction would prevent or impede the required miniaturization of the connector.

Second, with the connector described above, in the case that the contacts are arranged in the housing in a manner that their connection portions are located on the side of the insertion opening of the housing, it is unavoidable that the connection portions of the contacts extend from the housing in order to facilitate the induction of a circuit board or flat cable so that the extension of the connection portions from the housing would limit the miniaturization of the connector. In the case that extremely narrow pitches of contacts are required, the insertion of the contacts into the housing from only one side would also limit the miniaturization of the connector.

Third, in a connector having contacts whose contact portions are provided in symmetrical positions in order to embrace a flexible printed circuit board on both its sides, the contacts are often arranged alternately staggered for the purpose of miniaturizing the connector. In this case, patterns on the circuit board to be inserted into the connector should be arranged alternately staggered corresponding to the arrangement of the contacts of the connector. If the circuit board is inserted into the connector erroneously upside down, the patterns on the circuit board are improperly brought into contact with the contact portions of the contacts, resulting in defective or failed electrical connection. If such a defective or failed connection occurred, the connector itself or the circuit board itself would need to be replaced, resulting in an increased operating cost.

Fourth, in the so-called "non-zero insertion force" type connector, the force for inserting a circuit board into the connector and the force for holding the circuit board in the connector are generally determined substantially depending upon the contacting force (or pressure) of the contacts. In other words, the holding force is substantially equal to the contacting force per one contact multiplied by the number of contacts. If a customer demands a holding force of 5N, it is impossible for a connector having connection lines whose number is less than 10 to obtain the holding force of 5N. Therefore, the circuit board is slipped out of the connector to cause failed connections.

Even in the so-called "zero-insertion force" type connector, in which after a flexible printed circuit board has been inserted into the connector, the circuit board is urged against the contacts by the slider, although it is different from the "non-zero-insertion force" type connector only in the fact that initial value is increased by inserting the slider into the connector, the influence of the contacting force (pressure) of contacts is still great, and therefore the same holds true in case of the connector of this type in that it is impossible for the connector having connection lines less than 10 to obtain the holding force of 5N so that the circuit board will be slipped out of the connector.

In the connector disclosed in the Patent Literature 3 described above, the anchoring projections provided on the slider are inserted in and engaged with anchoring portions of the flexible cable. In such a connector, however, as the direction in which the slider is inserted is the same as the direction in which the flexible cable is inserted, the influence of the contacting force (pressure) of contacts is still great, and therefore the same holds true in this case so that with connection lines less than 10, the flexible cable will be slipped out of the connector.

In the combination of connectors disclosed in the Patent Literatures 2 and 3, the connector of so-called "piano touch" type in Literature 2 is further provided with anchoring projections formed in the slider and anchoring portions formed in the circuit board as the connector in Literature 3. With such a combination type connector, a required holding force can be obtained to some extent even if the connection lines are less than 10, because the direction in which the circuit board is inserted is different from the rotating direction of the slider. However, the slider's elasticity is poor, so that the slider or circuit board would be damaged when the circuit board is pulled by a force more than the holding force. Moreover, when the circuit board is accidentally subjected to an irregular force, such a force is usually a tension directed in obliquely upward direction, but not in the direction opposite to the inserting direction. Therefore, as the direction of the accidental irregular force is the same as the rotating direction of the slider, sometimes the required holding force cannot be obtained.

Fifth, in order to increase signal density, providing contact portions on both surfaces of a circuit board is increasingly being required. However, the connectors of the prior art described above could not accommodate such circuit boards having contact portions on both the surfaces and further could not accommodate much narrower pitches of contacts. In more detail, with the "zero-insertion force" type connector as disclosed in the Patent Literature 1, after the circuit board has been inserted into the connector, the circuit board is urged in one direction by means of the slider so as to contact the contacts of the connector. As the urging direction is only one direction, it is quite impossible to use this connector with a circuit board having contact portions on both the surfaces.

In the "piano touch" type connector disclosed in the Patent Literature 2 described above, the slider is pivotally moved on the side where the circuit board is inserted into the connector. In this construction, the circuit board is urged only in one direction by the slider so that this connector could not accommodate a circuit board having contact portions on both the surfaces.

Sixth, the height or thickness of connectors is increasingly being reduced so that nowadays a thickness of as little as 0.15 to 0.25 mm is pursued. With such an extremely thin housing, on inserting a circuit board into the connector, the housing could not withstand the contacting force so that the housing is deformed causing unstable connection leading to defective or failed connection and in a worse case causing damage to the housing. Making the housing thicker may avoid such a damage, but it could not accomplish the reduction in height. The connectors disclosed in the Patent Literatures 1 and 2 have the contacts arranged in narrower pitches and are much thinner (so-called lighter and more compact) so that aforementioned problems are particularly acute in these connectors.

SUMMARY OF THE INVENTION

It is a first object of the invention to provide a connector which will be able to urge a flexible printed circuit board or flat cable against contact portions of contacts by a slider in a reliable manner without degrading strength of respective parts and without deviating from customer's demands and will be easy to manufacture and operate and enable pitches of contacts to be narrower and the connector to be miniaturized, particularly in height.

It is a second object of the invention to provide a connector which will be able to surely conduct or guide a flexible printed circuit board or flat cable into an insertion opening of the connector and will enable pitches of contacts to be narrower and the connector to be miniaturized.

It is a third object of the invention to provide a connector which in no way causes defective or failed connection, even if a flexible printed circuit board is inserted into the connector erroneously upside down.

It is a fourth object of the invention to provide a connector having a required force for holding a flexible printed circuit board even in the case of a small number of connection lines, thereby completely eliminating any defective or failed connection.

It is fifth object of the invention to provide a connector which can be used with a flexible printed circuit board having contact portions on both its surfaces and whose contacts can be arranged with extremely narrow pitches.

It is a sixth object of the invention to provide a connector whose housing is not deformed when a flexible printed circuit board or flexible flat cable is inserted into the housing and which enables its height to be minimized.

In order to achieve the minimization of connector in height of the first object of the invention, in a connector adapted to be detachably fitted with a flexible printed circuit board or flexible flat cable, including a required number of contacts having at least one contact portion to contact the flexible printed circuit board or flexible flat cable, a housing holding and fixing the contacts therein and having an insertion opening through which the flexible printed circuit board or flexible flat cable is inserted into the housing, and a slider for urging the flexible printed circuit board or flexible flat cable against the contacts, according to the invention each of the contact further comprises a connection portion, and an elastic portion and a fulcrum portion provided between the contact portion and the connection portion, and a pressure receiving portion positioned in opposition to the connection portion and extending from the elastic portion so that the contact portion, the elastic portion, the fulcrum portion and the contact portion are arranged in the form of a crank, and the slider comprises urging portions arranged side by side in its longitudinal direction and is mounted in the housing such that the urging portions are able to be pivotally moved between the connection portions and the pressure receiving portions of the contacts.

In order to achieve the minimization of height and pitches of the first object of the invention, in a connector adapted to be detachably fitted with a flexible printed circuit board or flexible flat cable, including a required number of contacts having at least one contact portion to contact the flexible printed circuit board or flexible flat cable, a housing holding and fixing the contacts therein and having an insertion opening through which the flexible printed circuit board or flexible flat cable is inserted into the housing, and a slider for urging the flexible printed circuit board or flexible flat cable against the contacts, according to the invention the contacts consisting of contacts of two kind and arranged alternately staggered, each of the contacts of the one kind comprises a connection portion, and an elastic portion and a fulcrum portion provided between the contact portion and the connection portion, and a pressure receiving portion positioned in opposition to the connection portion and extending from the elastic portion so that the contact portion, the elastic portion, the fulcrum portion and the connection portion are arranged substantially in the form of a crank, and each of the contacts of the other kind comprises a connection portion, and an elastic portion and a fulcrum portion provided between the contact portion and the connection portion, and a pressure receiving portion extending from the elastic portion in the opposite direction to the contact portion so that the contact portion, the elastic portion, the fulcrum portion, and the connection portion are arranged substantially in the form of a U-shape, and further the slider comprises urging portions arranged side by side in its longitudinal direction and is mounted in the housing such that the urging portions are able to be pivotally moved between the connection portions and the pressure receiving portions of the contacts of the one kind and between the housing and the pressure receiving portions of the contacts of the other kind.

In order to achieve the second object of the invention, in a connector adapted to be detachably fitted with a flexible printed circuit board or flexible flat cable, including a required number of contacts having at least one contact portion to contact the flexible printed circuit board or flexible flat cable, and a housing holding and fixing the contacts therein and having an insertion opening through which the flexible printed circuit board or flexible flat cable is inserted into the housing, according to the invention the housing is provided on the side of the insertion opening with a recessed portion for conducting the flexible printed circuit board or flat cable into the housing so that the contacts are arranged in the housing so as not to permit connection portions of the contacts to extend from the recessed portion of the housing.

In order to achieve the third object of the invention, in a connector adapted to be detachably fitted with a flexible printed circuit board, including a required number of contacts each having an upper and a lower contact portion one above the other adapted to contact the flexible printed circuit board, and a housing holding and fixing the contacts therein and having an insertion opening through which the flexible printed circuit board is inserted into the housing, according to the invention when contact portions provided on the flexible printed circuit board to contact the contacts are arranged alternately staggered, the upper and lower contact portions of the contacts are also arranged alternately staggered.

In order to accomplish the fourth object of the invention, in a connector adapted to be detachably fitted with a flexible printed circuit board, including a required number of contacts each having at least one contact portion adapted to contact the flexible printed circuit board, and a housing holding and fixing the contacts therein and having an insertion opening through which the flexible printed circuit board is inserted into the housing, according to the invention the connector further comprises at least one locking member mounted on the housing and having an engaging portion which engages an anchoring portion provided in the flexible printed circuit board to prevent the flexible printed circuit board from being removed from the housing.

In order to accomplish the fifth object of the invention, in a connector adapted to be detachably fitted with a flexible printed circuit board, including a required number of contacts each having at least one contact portion adapted to contact the flexible printed circuit board, and a housing holding and fixing the contacts therein and having an insertion opening through which the flexible printed circuit board is inserted into the housing, according to the invention when the flexible printed circuit board has contact portions on both its surfaces, the contacts are of two kinds, and the contacts of one kind are arranged in the housing by inserting thereinto from opposite side of the insertion opening of the housing so that the contact portions of the contacts of the one kind are brought into contact with the contact portions on the one surface of the flexible printed circuit board, and the contacts of the other kind are arranged in the housing by inserting thereinto from the side of the insertion opening of the housing so that the contact portions of the contacts of the other kind are brought into contact with the contact portions on the other surface of the flexible printed circuit board.

In order to achieve the sixth object of the invention, in a connector adapted to be detachably fitted with a flexible printed circuit board or flexible flat cable, including a required number of contacts having at least one contact portion to contact the flexible printed circuit board or flexible flat cable, and a housing holding and fixing the contacts therein and having an insertion opening through which the flexible printed circuit board or flexible flat cable is inserted into the housing, according to the invention the connector further comprises a plate-shaped piece arranged at a location opposite the contact portions of the contacts.

The connectors for achieving the third, forth and fifth objects are used only with flexible printed circuit boards, while the connectors for achieving the first, second and sixth objects are used with flexible printed circuit boards or flexible flat cables. The connectors for all the first to sixth objects can be modified in the following manner.

The connector for achieving the first object can be variously modified as follows. Preferably, the pressure receiving portions of the contacts of either of the one and the other kinds each comprise a projection at the distal end to prevent the urging portions of the slider from moving toward the connection portions of the contacts of the one kind. By providing the projections, it is possible to prevent the slider from being deformed at its center due to strong reaction against the pivotal movement of the slider causing its urging portions to pivotally move between the connection portions and the pressure receiving portions of the contacts. Moreover, it is preferable that the urging portions of the slider are of an elongated shape. By employing such elongated urging portions, when the slider is pivotally moved, the pressure receiving portions of the contacts are securely raised so that the contact portions can easily be brought into contact with the flexible circuit board or flat cable.

It is preferable that the slider further comprises anchoring grooves independent from each other adapted to engage the projections of the contacts, respectively. By making the anchoring grooves independent from each other, the slider can be certainly pivotally moved without degrading the strength of the slider. Moreover, the contacts of the one kind are each further provided with a further contact portion in a direction extending from the fulcrum portion which is also adapted to contact the flexible printed circuit board or flat cable. By increasing the contact portions in opposition to the existing contact portions of the contacts in this manner, the flexible circuit board or flat cable is embraced on both the sides so that the contacts can contact the circuit board or flat cable with a great certainty.

Furthermore, the contacts of the other kind are each provided with a further contact portion between the fulcrum portion and the connecting portion, which is adapted to contact the flexible printed circuit board or flexible flat cable. By providing the contact portions on both the sides of the inserting direction of the board or cable in this manner, it is embraced by the contact portions to obtain the reliable connection therebetween. Moreover, the contacts of the other kind are each further provided with an extension portion extending from the fulcrum portion in the opposite direction to the connection portion, and the slider is mounted on the housing such that the urging portions of the slider are pivotally moved between the extension portions and the pressure receiving portions of the contacts. In this manner, the slider is caused to pivotally move between the extension portions and the pressure receiving portions, so that the contact portions of the contacts of the other kind are more securely urged against the circuit board or cable on pivotally moving the slider.

The connector for the second object can be modified as follows. In order to accommodate extremely narrow pitches of contacts, the contacts consist of contacts of two kinds, and the contacts of two kinds are arranged alternately staggered in the housing such that connection portions of the contacts of the one kind are located on the opposite side of the insertion opening and connection portions of the contacts of the other kind are located so as not to extend from the recessed portion of the housing. In order to that no force is applied onto the circuit board or flat cable when it is being inserted into the connector, the connector further comprises a slider and after the flexible printed circuit board or flat cable has been inserted through the insertion opening into the housing, the slider is inserted into the housing so as to urge the flexible printed circuit board or flat cable against the contact portions of the contacts by the slider.

In order to that no force is applied onto the circuit board or flat cable when it is being inserted into the connector, each of the contacts of the one kind comprises an elastic portion and a fulcrum portion provided between the contact portion and the connection portion, and a pressure receiving portion positioned in opposition to the connection portion and extending from the elastic portion so that the contact portion, the elastic portion, the fulcrum portion and the connection portion are arranged substantially in the form of a crank, and each of the contacts of the other kind comprises an elastic portion and a fulcrum portion provided between the contact portion and the connection portion, and a pressure receiving portion extending from the elastic portion in the opposite direction to the contact portion so that the contact portion, the elastic portion, the fulcrum portion, and the connection portion are arranged substantially in the form of a U-shape, and the contacts of the other kind are so arranged that their connection portions are located in the recessed portion of the housing, and further the slider comprises urging portions arranged side by side in its longitudinal direction and is mounted in the housing such that the urging portions are able to be pivotally moved between the connection portions and the pressure receiving portions of the contacts of the one kind and between the housing and the pressure receiving portions of the contacts of the other kind. The circuit board or flat cable can be guided with the aid of the connection portions of the contacts located in the recessed portions of the housing.

The connector for the fourth object can be modified as follows. The locking member further comprises a connection portion adapted to be connected to a board so as to serve as fixing means for fixing the connector to the board. As the locking member has the function as fixing means other than its inherent function, the locking member becomes more rigid to fulfil a required holding force certainly. In a preferred embodiment, the connector further comprises a slider which functions to urge the flexible printed circuit board against the contacts after the flexible printed circuit board has been inserted into the housing, with a view to obtaining a zero-insertion force structure in which no force is applied onto the flexible printed circuit board when it is being inserted into the insertion opening of the housing, and when the circuit board are urged against the contacts by the slider, the engaging portion of the locking member is brought into engagement with the anchoring portion of the flexible printed circuit board. By making the connector to be "zero-insertion force" type in this manner, when the circuit board is urged against the contacts by the slider, the engaging portion of the locking member engages the anchoring portion of the circuit board, thereby facilitating the insertion of the circuit board, achieving a positive engagement, and fulfilling a required holding force. Moreover, the housing further comprises a recessed portion on the side of the insertion opening for conducting the flexible printed circuit board into the housing, and the contacts are arranged so as not to permit the connection portions to extend from the recessed portion of the housing. With such an arrangement, the circuit board can be certainly guided into the insertion opening of the housing.

The contacts consist of contacts of two kinds, and the contacts of two kinds are arranged alternately staggered in the housing such that connection portions of the contacts of one kind are located on the opposite side of the insertion opening, and connection portions of the contacts of the other kind and connection portion of the locking member are located so as not to extend from the recessed portion of the housing. By arranging the two kinds of contacts and the locking member in this manner, the circuit board can be certainly guided into the insertion opening of the housing, and by arranging the connection portion of the locking member on the side of the insertion opening, the connector becomes less susceptible to an irregular force accidentally applying to the circuit board.

In a preferred embodiment, each of the contacts of the one kind comprises an elastic portion and a fulcrum portion provided between the contact portion and the connection portion, and a pressure receiving portion positioned in opposition to the connection portion and extending from the elastic portion so that the contact portion, the elastic portion, the fulcrum portion and the connection portion are arranged substantially in the form of a crank, and each of the contacts of the other kind comprises an elastic portion and a fulcrum portion provided between the contact portion and the connection portion, a pressure receiving portion extending from the elastic portion in the opposite direction to the contact portion, and an extension portion extending from the fulcrum portion and in opposition to the pressure receiving portion so that the contact portion, the elastic portion, the fulcrum portion, and the connection portion are arranged substantially in the form of a U-shape, and the contacts of the other kind are arranged that their connection portions are located in the recessed portion of the housing. Further, the slider comprises urging portions arranged side by side in its longitudinal direction and is mounted in the housing such that the urging portions are able to be pivotally moved between the connection portions and the pressure receiving portions of the contacts of the one kind and between the pressure receiving portions and the extension portions of the contacts of the other kind. As a result, the slider is pivotally moved on the opposite side of the insertion opening of the housing so that the connector becomes insusceptible to an irregular force acting upon the flexible circuit board, thereby obtaining required holding force. The locking member is formed in a construction the same as the contact of the other kind so that the "zero-insertion force" feature can be realized with the locking member, thereby ensuring enhanced locking of the flexible printed circuit board.

The connector for the fifth object can be modified as follows. The contacts of the two kinds are arranged in pairs each consisting of the different kind contacts so that the contacts portions of one pair of contacts are in opposition to each other to embrace the flexible printed circuit board therebetween. With this arrangement, the upper contact portions of the contacts are into contact with the contact portions on the upper surface of the flexible printed circuit board, while lower contact portions are in contact with the contact portions on the lower surface of the circuit board. In a preferred embodiment, the contact portions of each pair of the contacts are staggered relative to each other in the direction of rows of the contacts. With the pairs of the contacts alternately staggered, it is possible to arrange the contacts with the narrowest pitches. Preferably, the housing further comprises a recessed portion on the side of the insertion opening for conducting the flexible printed circuit board into the housing, and the contacts of the other kind are arranged so as not to permit the connection portions to extend from the recessed portion of the housing. With this arrangement, the circuit board can be more easily conducted or guided into the insertion opening of the housing.

In another embodiment, the connector further comprises a slider which functions to urge the flexible printed circuit board against the contacts after the flexible printed circuit board has been inserted into the housing, with a view to obtaining a zero-insertion force structure in which no force is applied onto the flexible printed circuit board when it is being inserted into the insertion opening of the housing. By converting the connector to the "zero-insertion force" type in this manner, the circuit board can be more easily inserted into the housing to bring the contact portions on the upper and lower surfaces of the circuit board into connection with the contacts. In a further embodiment, each of the contacts of the one kind comprises a connection portion, and an elastic portion and a fulcrum portion provided between the contact portion and the connection portion, and a pressure receiving portion positioned in opposition to the connection portion and extending from the elastic portion so that the contact portion, the elastic portion, the fulcrum portion and the connection portion are arranged substantially in the form of a crank, and each of the contacts of the other kind comprises the contact portion and the connection portion and is so arranged that the connection portion is located in the recessed portion of the housing. The slider comprises urging portions arranged side by side in its longitudinal direction and is mounted in the housing such that the urging portions are able to be pivotally moved between the connection portions and the pressure receiving portions of the contacts of the one kind. By pivotally moving the slider on the side opposite the insertion opening, the contacts are urged against the circuit board, whereby a circuit board having contact portions on upper and lower surfaces can be accommodated, and reliable connection can be achieved.

The connector for the sixth object can be modified as follows. The plate-shaped piece is arranged so as to extend into the insertion opening of the housing. With this arrangement, the plate-shaped piece can be easily fixed to the housing. In one embodiment, the plate-shaped piece is arranged only at a region in opposition to the contact portions of the contacts. In another embodiment, the plate-shaped piece is so formed that its ends extend outwardly from longitudinal ends of the housing so as to serve as fixing means for the connector, thereby fixing the connector to a board. The plate-shaped piece may be formed integrally with the housing to form a unitary structure.

The plate-shaped piece is made of stainless steel and has a thickness of the order of 0.08 to 0.12 mm. If it is less than 0.08 mm, the deformation of the housing cannot be prevented, while if more than 0.12 mm, the miniaturization in height of the connector cannot be accomplished. The thickness of 0.1 mm is most preferable. The plate-shaped piece is formed integrally with the housing, or after the plate-shaped piece has been formed, it is joined to the housing to form a unitary body. In one embodiment, the contacts each comprise a connection portion, and an elastic portion and a fulcrum portion provided between the contact portion and the connection portion, and a pressure receiving portion positioned in opposition to the connection portion and extending from the elastic portion so that the contact portion, the elastic portion, the fulcrum portion and the connection portion are arranged in the form of a crank, and the connector further comprises a slider provided with urging portions arranged side by side in its longitudinal direction and mounted in the housing such that the urging portions are able to be pivotally moved between the connection portions and the pressure receiving portions of the contacts.

The connector having a slider pivotally movable on the side of the connection portions of the contacts (on the opposite side of the insertion opening) will perform the following function. After a flexible printed circuit board or flat cable has been inserted into the insertion opening of the housing, when the slider is pivotally moved to cause its urging portions to pivotally move between the connection portions and the pressure receiving portions of the contacts of the one kind and between the pressure receiving portions and the extension portions of the contacts of the other kind, the pressure receiving portions are urged upward by the urging portions so that the elastic portions of the contacts of both the kinds are tilted about the fulcrum portions toward the contact portions, thereby urging the contact portions to the circuit board or flat cable.

The connector having a housing formed with the recessed portions on the side of the insertion opening will perform the following function. When a flexible printed circuit board or flat cable is about to be inserted into the insertion opening, the front end of the circuit board will abut against the connection portions of the contacts arranged in the recessed portion of the housing so that the circuit board or flat cable is easily conducted into the insertion opening of the housing.

The connector having the locking member for the forth object will perform the following function. When a flexible printed circuit board is being inserted into the insertion opening of the housing, the engaging portions of the locking members are raised upward owing to the elasticity of the engaging portions so as to engage the anchoring portions of the circuit board. By forming the locking members in the "zero-insertion force" type, when the circuit board is being inserted into the insertion opening of the housing, the engaging portions of the locking members will easily engage the anchoring portions of the circuit board without scratching the circuit board.

The connector for the first object of the invention has the following significant functions and effects.

(1) The connector according to the invention has the construction in that the contact portions of the contacts are brought into contact with a flexible printed circuit board or flat cable by pivotally moving the slider on the side of the connection portions of the contacts. Therefore, there is no need to insert the slider into the insertion opening of the housing so that the connector can be miniaturized, particularly in its height by the thickness of the slider.

(2) According to the invention, the miniaturization, particularly, reduction in height can be easily realized with the construction having two kinds of contacts, the contacts of the one kind being inserted into the housing from the side of the connection portions of the contacts and the contacts of the other kind being inserted from the side of the insertion opening, and a slider adapted to be pivotally moved on the side of the connection portions.

(3) According to the invention, after a flexible printed circuit board or flat cable has been inserted into the insertion opening of the housing, when the slider is pivotally moved to cause its urging portions to pivotally move between the connection portions and the pressure receiving portions of the contacts of the one kind, the pressure receiving portions are urged upward by the urging portions so that the elastic portions of the contacts are tilted about the fulcrum portions toward the contact portions to urge the contact portions of the contacts against the circuit board or flat cable, thereby ensuring the reliable connection between the contacts and circuit board or flat cable.

(4) According to the invention, after a flexible printed circuit board or flat cable has been inserted into the insertion opening of the housing, when the slider is pivotally moved to cause its urging portions to pivotally move between the housing and the pressure receiving portions of the contacts of the one kind or between the pressure receiving portions and the extension portions, the pressure receiving portions are urged upward by the urging portions so that the elastic portions of the contacts are tilted about the fulcrum portions toward the contact portions to urge the contact portions of the contacts against the circuit board or flat cable, thereby ensuring the reliable connection between the contacts and circuit board or flat cable.

(5) According to the invention, the contacts of the one kind or the contacts of both the kinds are each provided with a projection at the free end of the pressure receiving portion. It is possible to prevent the slider from being deformed at its center due to strong reaction against the pivotal movement of the slider when causing its urging portions to pivotally move between the connection portions and the pressure receiving portions of the contacts.

(6) According to the invention, the urging portions of the slider are of an elongated shape (having major and minor axes). By employing such elongated urging portions, when the slider is pivotally moved, the pressure receiving portions of the contacts are securely raised so that the contact portions can easily be brought into contact with the flexible circuit board or flat cable.

(7) According to the invention, the slider comprises anchoring grooves independent from each other adapted to engage the projections of the contacts. As a result, the slider can be certainly pivotally moved without being deformed and without degrading the strength of the slider.

(8) According to the invention, the contacts of the one kind are each provided with a further contact portion in the direction extending from the fulcrum portion which is adapted to contact the circuit board or flat cable. With this arrangement, the circuit board or flat cable is embraced on both the side so that the contacts can contact the circuit board or flat cable in a move reliable manner.

(9) According to the invention, the contacts of the other kind are each provided with a further contact portion between the fulcrum portion and the connection portion, which is adapted to contact the circuit board or flat cable. With this arrangement, there are contact portions of the contacts arranged on both the sides in vertical direction with respect to the inserting direction of the circuit board or flat cable so that the board or cable is embraced by the contact portions to obtain the reliable connection between the board or cable and the contact portions of the contacts.

(10) According to the invention, the insertion of the circuit board or flat cable takes place on the side of the insertion opening of the housing, while the urging of the contact portions of the contacts against the circuit board or flat cable takes place on the side of the connection portions of the contacts. Therefore, even if the connector is miniaturized to the extreme extent, the operation of the connector can be easily performed without adversely affecting the operation.

The connector for the second object of the invention has the following significant functions and effects.

(1) According to the invention, the housing is formed with a recessed portion for conducting a flexible printed circuit board or flat cable into the housing on the same side of the insertion opening, and the connection portions of the contacts are arranged so as not to extend from the interior of the recessed portion, thereby enabling the circuit board or flat cable to be certainly conducted.

(2) According to the invention, the contact portions of the contacts are brought into contact with the circuit board or flat cable by pivotally moving the slider on the side of the connection portions of the contacts without requiring the insertion of a slider. With this construction, it becomes possible to reduce the height of the connector by the thickness of the slider.

(3) According to the invention, the miniaturization, particularly, reduction in height can be easily realized with the construction having two kinds of contacts, the contacts of the one kind being inserted into the housing from the side of the connection portions of the contacts and the contacts of the other kind being inserted from the side of the insertion opening, and a slider adapted to be pivotally moved on the side of the connection portions.

(4) According to the invention, the insertion of the circuit board or flat cable takes place on the side of the insertion opening of the housing, while the urging of the contact portions of the contacts against the circuit board or flat cable takes place on the side of the connection portions of the contacts. Therefore, even if the connector is miniaturized to the extreme extent, the operation of the connector can be easily performed without adversely affecting the operation.

(5) According to the invention, after a flexible printed circuit board or flat cable has been inserted into the insertion opening of the housing, when the slider is pivotally moved to cause its urging portions to pivotally move between the connection portions and the pressure receiving portions of the contacts of the one kind, the pressure receiving portions are urged upward by the urging portions so that the elastic portions of the contacts are tilted about the fulcrum portions toward the contact portions to urge the contact portions of the contacts against the circuit board or flat cable, thereby ensuring the reliable connection between the contacts and circuit board or flat cable.

(6) According to the invention, after a flexible printed circuit board or flat cable has been inserted into the insertion opening of the housing, when the slider is pivotally moved to cause its urging portions to pivotally move between the pressure receiving portions and extension portion of the contacts of the other kind, the pressure receiving portions are urged upward by the urging portions so that the elastic portions of the contacts are tilted about the fulcrum portions toward the contact portions to urge the contact portions of the contacts against the circuit board or flat cable, thereby ensuring the reliable connection between the contacts and circuit board or flat cable.

(7) According to the invention, the contacts of the one kind or the contacts of both the kinds are each provided with a projection at the free end of the pressure receiving portion. It is possible to prevent the slider from being deformed at its center due to strong reaction against the pivotal movement of the slider when causing its urging portions to pivotally move between the connection portions and the pressure receiving portions of the contacts.

(8) According to the invention, the urging portions of the slider are of an elongated shape (having major and minor axes). By employing such elongated urging portions, when the slider is pivotally moved, the pressure receiving portions of the contacts are securely raised so that the contact portions can easily be brought into contact with the flexible circuit board or flat cable.

(9) According to the invention, the slider comprises a required number of anchoring grooves independent from each other adapted to engage the projections of the contacts. As a result, the slider can be certainly pivotally moved without being deformed and without degrading the strength of the slider.

(10) According to the invention, the contacts of the one kind are each provided with a further contact portion in the direction extending from the fulcrum portion which is adapted to contact the circuit board or flat cable. With this arrangement, the circuit board or flat cable is embraced on both the side so that the contacts can contact the circuit board or flat cable in a move reliable manner.

(11) According to the invention, the contacts of the other kind are each provided with a further contact portion between the fulcrum portion and the connection portion, which is adapted to contact the circuit board or flat cable. With this arrangement, there are contact portions of the contacts arranged on both the sides in vertical direction with respect to the inserting direction of the circuit board or flat cable so that the board or cable is embraced by the contact portions to obtain the reliable connection between the board or cable and the contact portions of the contacts.

The connector for the third object of the invention has the following significant functions and effects.

(1) In the case of a flexible printed circuit board whose contact portions adapted to contact the contact portions of the contacts are arranged alternately staggered, the contacts each having an upper and a lower contact portion one above the other, and the upper and lower contact portions of the contacts are also arranged alternately staggered. With this arrangement, no defective or failed connection occurs, even if the circuit board is inserted into the connector erroneously upside down.

(2) According to the invention, as no failed connection occurs even if the board is inserted erroneously upside down, there is no longer any need to exchange the connector or circuit board itself, so that there is no longer any increase in operating cost.

(3) According to the invention, the contact portions of the contacts are provided positionally corresponding to the contact portions of the circuit board so that stable connection can be ensured.

The connector for the fourth object of the invention has the following significant functions and effects.

(1) According to the invention, the connector comprises locking members each mounted on the housing and having an engaging portion which engages each of anchoring portions provided in a flexible printed circuit board to present it from being removed. Therefore, a required holding force can be obtained, and no defective or failed connection occurs.

(2) According to the invention, the locking member is provided with a connection portion adapted to be connected to a board so as to serve as fixing means for fixing the connector to the board. Therefore, the locking member becomes more rigidity to fulfil the required holding force.

(3) According to the invention, the flexible printed circuit board inserted into the connectors is urged against the contacts by a slider and at the same time the engaging portion of the locking member is brought into engagement with the anchoring portion of the flexible printed circuit board, thereby realizing a connector of "zero-insertion force" type in which no force is applied to the circuit board when it is inserted into the connector. Therefore, the circuit board can be easily inserted into the connector and the reliable engagement with the contacts with the required holding force.

(4) According to the invention, the housing is provided with a recessed portion on the side of the insertion opening for conducting the circuit board into the housing, and the contacts are so arranged to prohibit the connection portions from extending out of the interior of the recessed portion of the housing. Accordingly, the circuit board can be certainly guided into the insertion opening of the housing.

(5) According to the invention, there are contacts of two kinds arranged alternately staggered in the housing such that connection portions of the contacts of one kind are located on the opposite side of the insertion opening and connection portions of the contacts of the other kind and connection portions of the locking members are located so as not to extend out of the interior of the recessed portion. Accordingly, the circuit board can be certainly conducted into the insertion opening of the housing and the connector becomes insusceptible to an irregular force acting upon the flexible circuit board, thereby exhibiting required holding force.

(6) According to the invention, each of the contacts of the one kind comprises an elastic portion and a fulcrum portion provided between the contact portion and the connection portion, and a pressure receiving portion positioned in opposition to the connection portion and extending from the elastic portion so that the contact portion, the elastic portion, the fulcrum portion and the connection portion are arranged substantially in the form of a crank, and each of the contacts of the other kind comprises an elastic portion and a fulcrum portion provided between the contact portion and the connection portion, a pressure receiving portion extending from the elastic portion in the opposite direction to the contact portion, and an extension portion extending from the fulcrum portion and in opposition to the pressure receiving portion so that the contact portion, the elastic portion, the fulcrum portion, and the connection portion are arranged substantially in the form of a U-shape, and the contacts of the other kind are arranged that their connection portions are located in the recessed portion of the housing. Further, the slider comprises urging portions arranged side by side in its longitudinal direction and is mounted in the housing such that the urging portions are able to be pivotally moved between the connection portions and the pressure receiving portions of the contacts of the one kind and between the pressure receiving portions and the extension portions of the contacts of the other kind. As a result, the slider is pivotally moved on the opposite side of the insertion opening of the housing so that the connector becomes insusceptible to an irregular force acting upon the flexible circuit board, thereby obtaining required holding force.

(7) According to the invention, the locking member is formed in the same construction as the contact of the other kind. Therefore, the "zero-insertion force" type can be realized on the locking members so that the flexible printed circuit board can be firmly locked.

(8) According to the invention, the contact portions of the contacts are brought into contact with the circuit board by pivotally moving the slider on the side of the connection portions of the contacts. With this construction, it becomes possible to reduce the height of the connector by the thickness of the slider because there is no need to insert a slider.

(9) According to the invention, the miniaturization, particularly, reduction in height can be easily realized with the construction having two kinds of contacts, the contacts of the one kind being inserted into the housing from the side of the connection portions of the contacts and the contacts of the other kind being inserted from the side of the insertion opening, and a slider adapted to be pivotally moved on the side of the connection portions.

The connector for the fifth object of the invention has the following significant functions and effects.

(1) According to the invention, when the flexible printed circuit board has contact portions on both its surfaces, contacts of two kinds are used and the contacts of one kind are arranged in the housing by inserting thereinto from the opposite side of the insertion opening of the housing so that the contact portions of the contacts of the one kind are brought into contact with the contact portions on the one surface of the circuit board, and the contacts of the other kind are arranged in the housing by inserting thereinto from the side of the insertion opening of the housing so that the contact portions of the contacts of the other kind are bought into contact with the contact portions on the other surface of the circuit board. With this arrangement, it is easy to accommodate the circuit board having contact portions on both the surfaces and to achieve the miniaturization of the connector and enhance signal density.

(2) According to the invention, the contacts of the two kinds are arranged in pairs each consisting of the different kind contacts so that the contact portions of one pair of contacts are in opposition to each other to embrace the circuit board between the opposite contact portions of the contacts in pairs. Therefore, the contact portions of the contacts of the two kinds can easily contact the contact portions of the circuit board on both the surfaces, respectively.

(3) According to the invention, the contact portions of each pair of the contacts are staggered relative to each other in the direction of rows of the contacts when the flexible printed circuit board has contact portions provided on both its surfaces and staggered relative to each other in the direction of rows of the contact portions. Therefore, it is possible for the connector to arrange the contacts with narrower pitches to increase the signal density and to accommodate the positions of the contact portions of the circuit board.

(4) According to the invention, the housing comprises a recessed portion on the side of the insertion opening for conducting the flexible printed circuit board into the housing, and the contacts of the other kind are so arranged to prohibit the connection portions from extending out of the interior of the recessed portion of the housing. Accordingly, the circuit board can be guided into the insertion opening of the housing with great certainty.

(5) According to the invention, the flexible printed circuit board already inserted into the connector is urged against the contacts by the use of a slider, thereby obtaining a connector of "zero-insertion force" type in which no force is applied to the circuit board when it is being inserted into the connector. With this arrangement, the flexible circuit board can be easily inserted into the insertion opening of the housing so that contacts can be connected to the connection portions of the circuit board on both the surfaces in a reliable manner.

(6) According to the invention, each of the contact of the one kind comprises an elastic portion and a fulcrum portion between the contact portion and the connection portion and a pressure receiving portion positioned in opposition to the connection portion and extending from the elastic portion so that the contact portion, the elastic portion, the fulcrum portion and the connection portion are arranged substantially in the form of a crank, and each of the contacts of the other kind comprises a contact portion and a connection portion and is so arranged that the connection portion is located in the recessed portion of the housing, and further the slider comprises urging portions arranged side by side in its longitudinal direction and is mounted in the housing such that the urging portions are able to be pivotally moved between the connection portions and the pressure receiving portions of the contacts of the one kind. With this arrangement, as the contacts are urged against the circuit board by pivotally moving the slider at a position on the opposite side of the insertion opening of the housing, this connector can accommodate a flexible printed circuit board having contact portions on both its surfaces so that the contacts of the connector can be brought into contact with the circuit board with great certainty.

(7) According to the invention, the contact portions of the contacts of two kinds are brought into contact with the circuit board by pivotally moving the slider on the side of the connection portions of the contacts. With this construction, it becomes possible to reduce the height of the connector by the thickness of the slider because there is no need to insert a slider.

The connector for the sixth object of the invention can bring about the following significant functions and effects.

(1) When a flexible printed circuit board or flat cable is inserted into the insertion opening of the housing, the circuit board or flat cable is urged downward by the contacting force of the contact portions of the contacts so that the housing is also urged downward. According to the invention, however, the plate-shaped piece fixed to the housing prevents the housing from being deformed, thereby ensuring stable connection between the contacts and the circuit board or flat cable.

(2) According to the invention, the plate-shaped piece is formed to have a thickness of the order of 0.08 to 0.12 mm. Therefore, the plate-shaped piece does not adversely affect the miniaturization of the connector, particularly reduction of its height.

(3) According to the invention, the plate-shaped piece is arranged so as to extend into the insertion opening of the housing. Accordingly, the plate-shaped piece can be readily fixed to the housing.

(4) According to the invention, the plate-shaped piece is so formed that its ends extend outwardly from longitudinal ends of the housing so as to serve as fixing means for the connector. With this arrangement, the connector is securely fixed to a flexible printed circuit board or the like.

(5) By fixing the plate-shaped piece to the housing, there is no need to extend the contacts from the fulcrum portions to the insertion opening, that is, there is no need an extension portion of the contact, so that the plate-shaped piece can be used which is thinner than extension portions of contacts. Moreover, the housing can also be thinner than the case having such extension portions, thereby enabling the connector to be thinner as a whole.

(6) By fixing the plate-shaped piece to the housing, no deformation of the housing occurs when a circuit board or flat cable is inserted into the insertion opening of the housing, even if the thickness of the housing (including the plate-shaped piece) is less than 0.2 mm.

(7) According to the invention, the plate-shaped piece is formed integrally with the housing, or after the plate-shaped piece has been formed, it is jointed to the housing to form a unitary body, thereby ensuring stable connection between the contacts and the printed circuit board or flat cable.

(8) By forming the plate-shaped piece of stainless steel, the housing is reinforced to prevent its deformation, thereby obtaining stable connection between the contacts and the circuit board or flat cable.

The invention will be more fully understood by referring to the following detailed embodiments taken in connection with the appended drawings.

DESCRIPTION OF THE PREFERRED EMBODIMENTS

The connectors for achieving the first to sixth objects of the invention have novel features for bringing a flexible printed circuit board or flat cable into contact with electrical contacts, being divided into three constructions. The connector of the first construction mainly comprises a housing, contacts and a slider which is pivotally moved to urge the circuit board against the contacts. This type of connector is so-called "piano touch" type. The position where the slider is pivotally moved may be on the side of an insertion opening for the circuit board or on the side of connections of the contacts.

The connector of the second construction also mainly comprises a housing, contacts and a slider which is inserted into an insertion opening of the housing to urge the circuit board against the contacts. This type of connector is so-called "zero-insertion force" type. In other words, after the circuit board has been inserted through the insertion opening into the housing, the slider is inserted into the insertion opening to urge the circuit board against the contacts.

The connector of the third construction mainly comprises a housing and contacts. A circuit board is inserted through an insertion opening into the housing to urge the circuit board against the contacts without using a slider. This type of connector is so-called "non-zero-insertion force" type. In other words, the circuit board is forced into spaces narrower its thickness between contact portions of the contacts or between the contacts and the housing to bring about the circuit board into contact with the contacts.

FIGS. 1 to 4 illustrate a connector according to the first aspect of the invention which will be explained hereinafter. The connector mainly comprises a housing 12, a slider 16 and contacts 14. First, the contacts will be explained. The contacts are made of a metal and formed by the press-working in the conventional manner. Preferred materials from which to form the contacts include brass, beryllium copper, phosphor bronze and the like to fulfil the requirement imposed thereon, springiness, conductivity and the like.

Figure 4A:
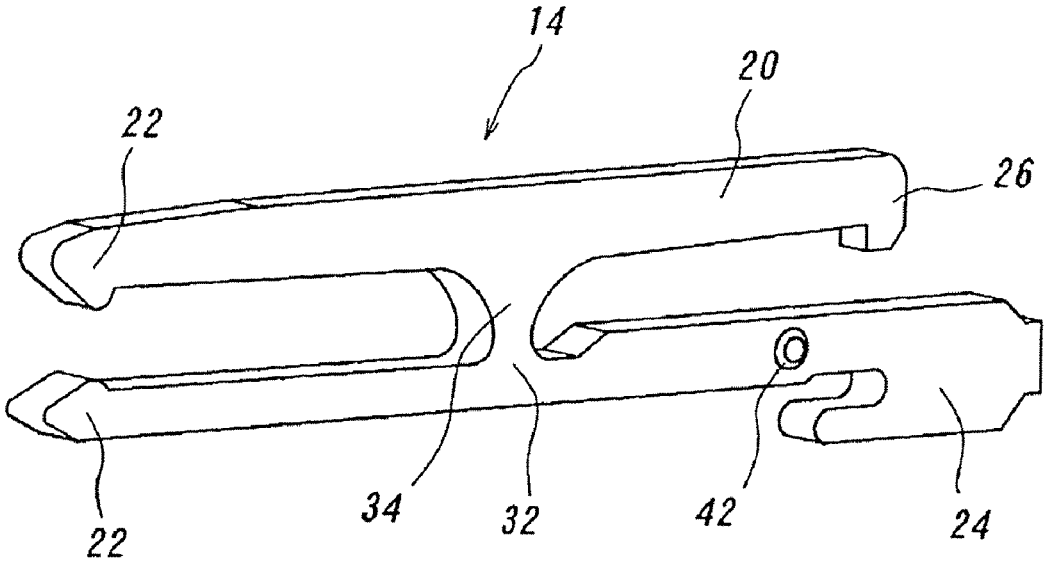
FIG. 4A is a perspective view of a contact having two contact portions used in the connector according to the invention.

As shown in FIG. 4A, the contact is "H-shaped" and mainly composed of an upper contact portion 22 adapted to contact a flexible printed circuit board or flexible flat cable, a connection portion 24 adapted to be connected to a board or substrate, a fixed portion 42 to be fixed to the housing 12, an elastic portion 34 and a fulcrum portion 32 provided between the upper contact portion 22 and the connection portion 24, a pressure receiving portion 20 positioned in opposition to the connection portion 24 and extending from the elastic portion 34, and a lower contact portion 22 extending from the fulcrum portion 32 and positioned in opposition to the upper contact portion 22 and adapted to contact the flexible printed circuit board 40 or flat cable.

The upper contact portion 22, the elastic portion 34, the fulcrum portion 32 and the connection portion 24 are arranged in the form of a crank. The contact portions 22 are each formed with a protrusion at free end to facilitate the contacting with the circuit board or flat cable. Although the connection portions 24 are shown of a surface mounting type (SMT) in the embodiment shown in FIG. 1B, it will be apparent that they may be of a dip type. In the illustrated embodiment, there are provided two contact portions 22 to embrace therebetween a flexible printed circuit board 40 or flexible flat cable. By providing the two contact portions 22 on both sides of the insertion direction of the flexible printed circuit board 40 or flexible flat cable, the circuit board or flat cable is embraced by the two contact portions 22 to ensure the reliable connection therebetween.

The fulcrum portion 32, the elastic portion 34 and the pressure receiving portion 20 function as follows when the board 40 or cable has been inserted into the connector. After the board 40 or cable has been inserted into an insertion opening 18 of the housing 12, the slider 16 is pivotally moved about its axles 28 (FIG. 3) to pivotally move its urging portions 36 in the space between the connection portions 24 and the pressure receiving portions 20 of the contacts 14 so that the pressure receiving portions 20 are urged upward by the urging portions 36 of the slider 16, as a result of which the elastic portions 34 of the contacts 14 are tilted toward the contact portions 22 with the aid of their fulcrums portions 32 to force their upper contact portions 22 against the flexible printed circuit board or flat cable. The fulcrum portion 32, the elastic portion 34 and the pressure receiving portion 20 are suitably designed particularly on their sizes and shapes to achieve these functions.

Figure 1A:
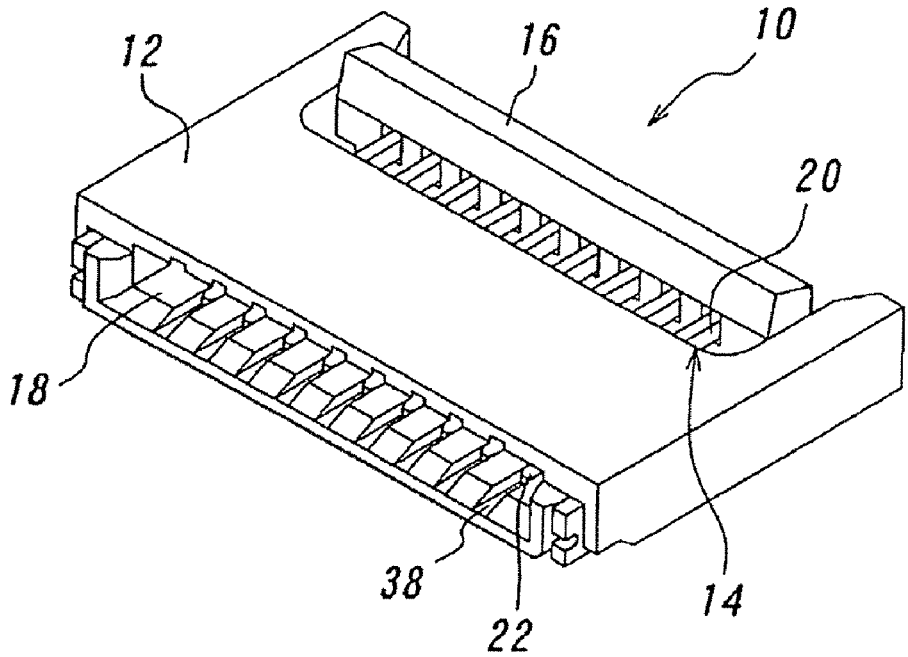
FIG. 1A is a perspective view of a connector achieving the first object of the invention with its slider in the opened condition, viewed from the insertion opening of the housing.
Figure 1B:
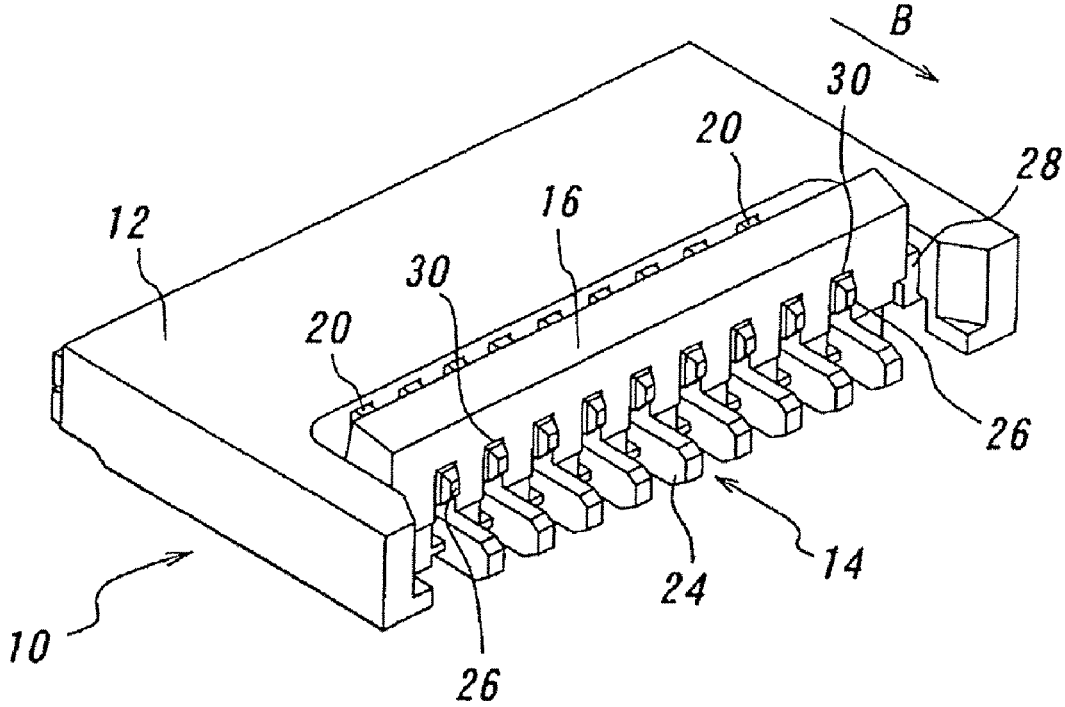
FIG. 1B is a perspective view of a connector achieving the first object of the invention with its slider in the opened condition, viewed from the side of connection portions of the contacts.
Figure 2A:
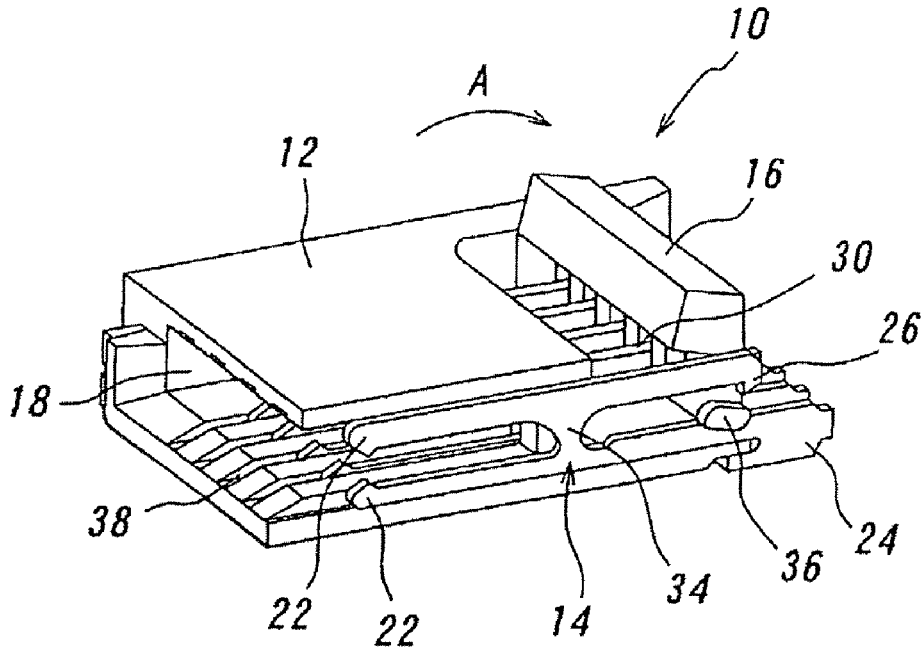
FIG. 2A is a perspective view of the connector shown in FIG. 1A partly cut away along one contact with its slider in the opened condition.
Figure 2B:
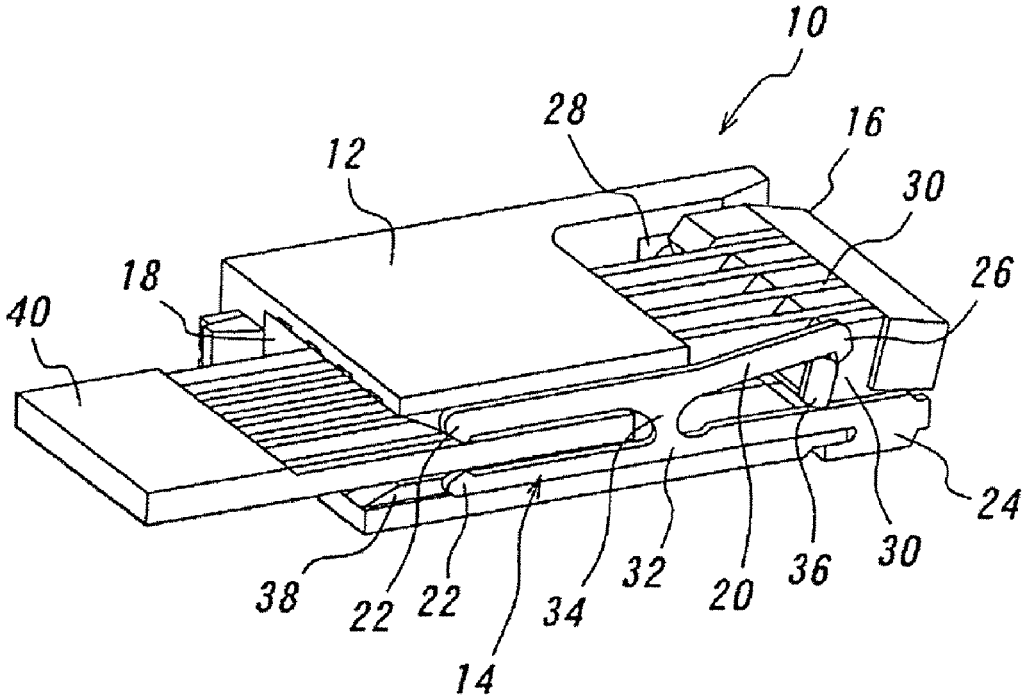
FIG. 2B is a perspective view of the connector shown in FIG. 1A partly cut away along one contact with a flexible printed circuit board inserted therein with the slider in the closed condition.
Figure 3:
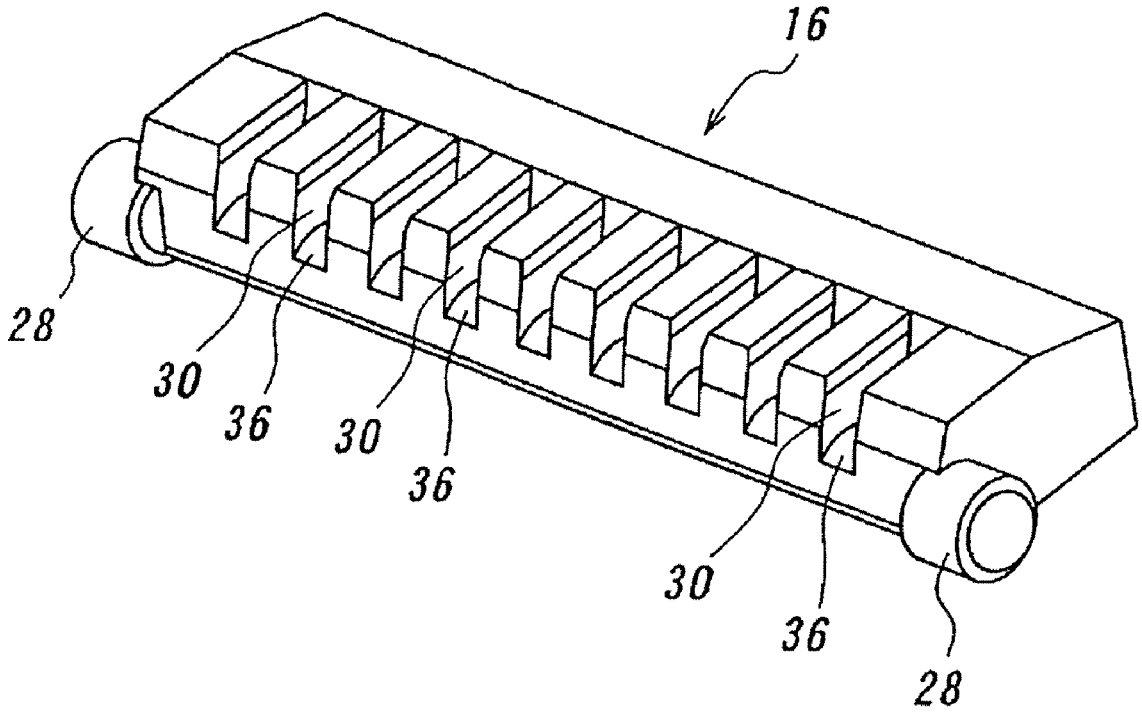
FIG. 3 is a perspective view of the slider shown in FIG. 1A.

It is preferably to provide a projection 26 at the free end of the pressure receiving portion 20 of the contact 14 to prevent the slider 16 from being deformed at its center in the direction shown by an arrow B in FIG. 1B due to strong reaction against the pivotal movement of the slider 16 when causing its urging portions 36 to pivotally move between the connection portions 24 and the pressure receiving portions 20 of the contacts 14. The projection 26 may be formed in any size so long as it can perform its function and may be so designed that the urging portion 36 of the slider 16 securely engages the projection 26.

Figure 4B:
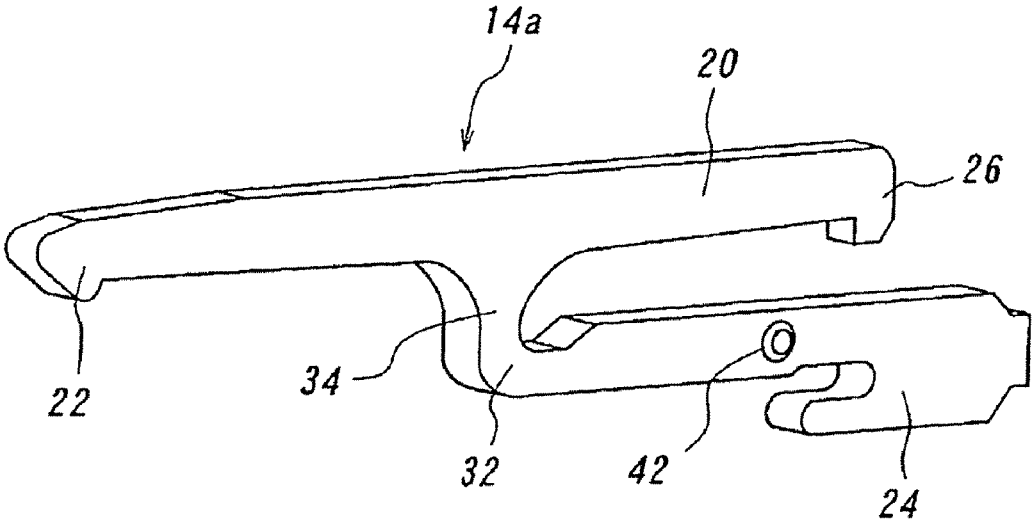
FIG. 4B is a perspective view of another contact having only one contact portion used in the connector.

FIG. 4B illustrates a contact 14*a* according to another embodiment which is slightly different from the contact 14 described above. The contact 14*a* is "h-shaped" which does not have the lower contact portion 22 of the contact 14.

The slider will be explained which is another subject feature of the invention. The slider 16 is injection molded from an electrically insulating plastic material in the conventional manner. Preferred materials from which to form the slider 16 include polyphenylene sulfide (PPS), polybutylene terephthalate (PBT), polyamide (66PA or 46PA), liquid crystal polymer (LCP), polycarbonate (PC) and the like and combinations thereof in view of the requirements imposed on the slider 16 with respect to dimensional stability, workability, manufacturing cost and the like.

The slider 16 mainly comprises axles 28 adapted to be rotatably fitted in the housing 12, urging portions 36 for urging the pressure receiving portions 20 of the contacts 14, and anchoring grooves 30 adapted to be engaged with the projections 26 of the contacts 14. The axles 28 are fulcrums for the pivotal movement of the slider and fitted in the housing 12 at locations in the proximity of longitudinal ends of the housing 12. The slider 16 is further provided at the longitudinal ends with locking portions adapted to engage the housing 12 for preventing the slider 16 from being lifted (in the upward direction in the drawing) when the pressure receiving portions 20 of the contacts 14 are urged by the urging portions 36 of the slider 16. The locking portions can be in any size and shape so long as they can engage the housing 12 and suitably designed in consideration of their function and the size and strength of the connector.

The urging portions 36 serve to urge the pressure receiving portions 20 of the contacts 14 and are preferably of an elongated shape, elliptical in the illustrated embodiment. With such an elliptical shape, when the slider 16 is pivotally moved in the direction shown by an arrow A in FIG. 2A so as to rotate its urging portion in the space between the pressure receiving portions 20 and the connection portions 24 of the contacts 14, the pressure receiving portions 20 of the contacts 14 are moved upward with variation in contacting height owing to the elliptical shape of the urging portions, resulting in the reliable clamping of contact portions of the flexible printed circuit board 40 or flat cable. The urging portions 36 can be formed in any shape insofar as they can rotate between the pressure receiving portions 20 and the connection portions 24 of the contacts 14, and the pressure receiving portions 20 of the contacts 14 can be raised with the aid of the variation in contacting height owing to, for example, difference in major and minor axes of an ellipse.

The slider 16 is further provided with the anchoring grooves 30 independently from each other, which are adapted to engage the projections 26 of the contacts 14 for the purpose of preventing the slider 16 from being deformed at the middle in the direction B in FIG. 1B due to the reaction against the pivotal movement of the slider 16 when being pivotally moved. The independently provided anchoring grooves 30 serve to increase the strength of the slider and to prevent its deformation when being pivotally moved.

The housing 12 will be explained. Preferred materials from which to form the housing 12 are substantially the same as those of the slider 16. The housing 12 is formed with insertion grooves 38 in which a required number of contacts 14 or 14*a* are inserted and fixed thereat by press-fitting, lancing, welding or the like. The housing 12 is further provided in the proximity of the longitudinal ends with holes or bearings for rotatably supporting the axles 28 of the slider 16. The holes or bearings of the housing 12 can be in any shape and size so long as the slider 16 can be rotated and are suitably designed in consideration of their functions and the strength and size of the housing 12. The housing 12 is further provided at the longitudinal ends with anchoring portions at locations corresponding to the locking portions of the slider 16.

Figure 5:
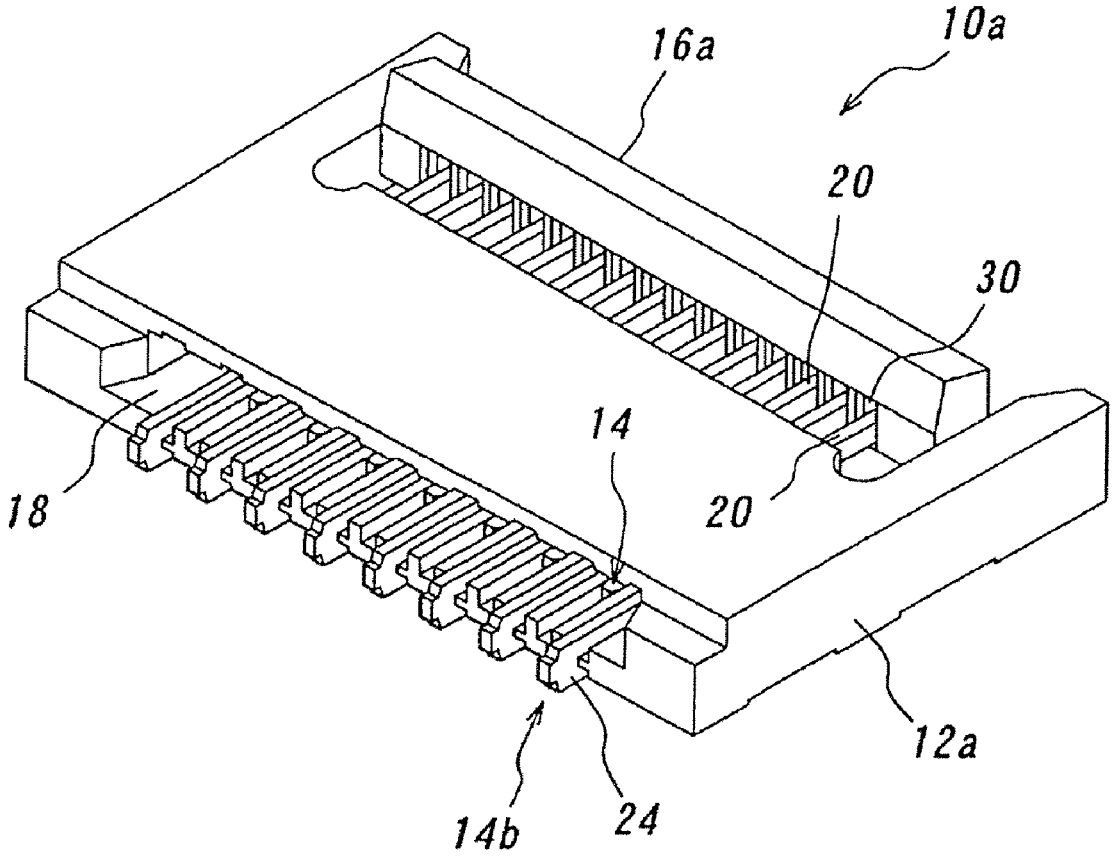
FIG. 5 is a perspective view of a connector according to another embodiment of the invention.
Figure 6A:
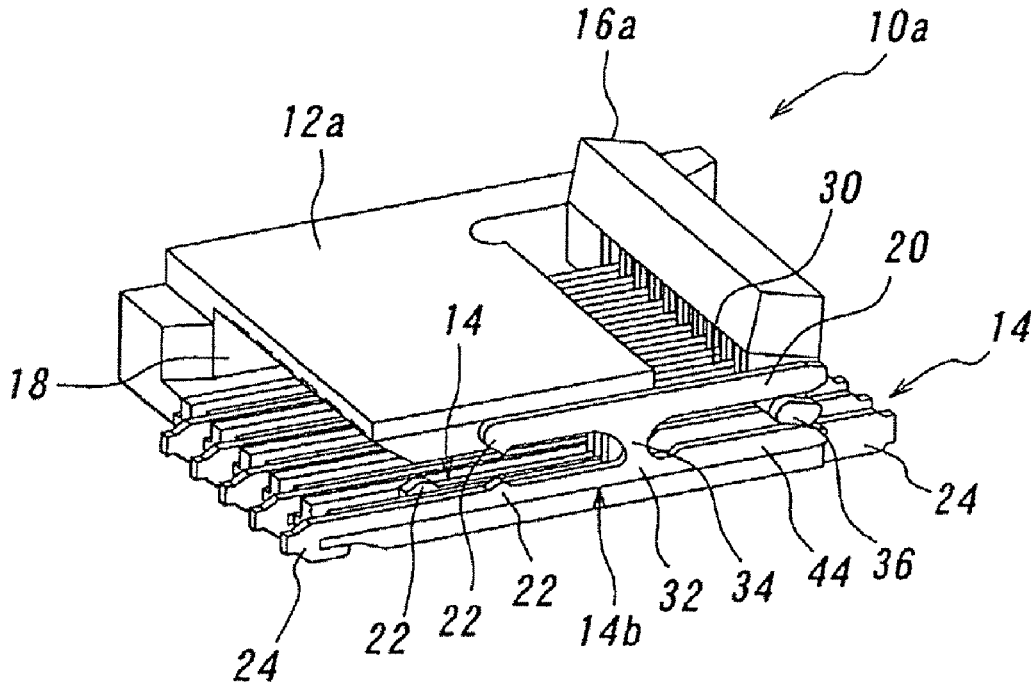
FIG. 6A is a perspective view of a connector according to the another embodiment of the invention partly cut away along one contact with its slider in the opened condition.
Figure 6B:
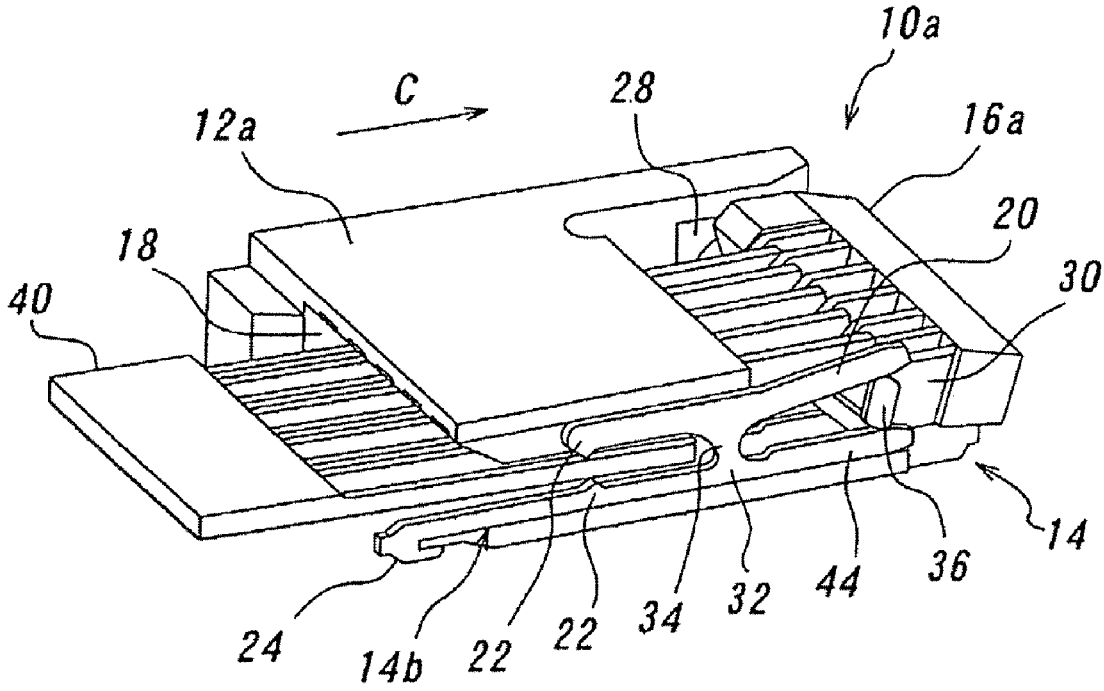
FIG. 6B is a perspective view of the connector shown in FIG. 6A partly cut away along one contact with a flexible printed circuit board inserted therein with the slider in the closed condition.

FIG. 5 and FIGS. 6A and 6B illustrate a connector 10*a* according to another embodiment of the first aspect of the invention. The connector 10*a* comprises a housing, a slider and contacts similar to the connector 10. The subject matter of the connector 10*a* of this embodiment lies in the fact that two kinds of the contacts 14 and 14*b* are arranged to be alternately staggered in the housing 12*a*. The contacts 14 and 14*b* are inserted into the housing 12*a* in opposite directions alternately, thereby achieving narrower pitches of the contacts and minimizing the height of the connector. As the housing 12*a*, the slider 16*a* and the contacts 14 are substantially same as those in the previous embodiment, these will not be described in further detail.

The remaining contacts 14*b* are made of a metal and formed by the press-working in the conventional manner. Preferable materials for the contacts 14*b* are the same as those of the contacts 14.

There are two types of the contacts 14*b*, that is, "h-shaped" and "H-shaped". The "h-shaped" contact 14*b* is mainly composed of a contact portion 22 adapted to contact a flexible printed circuit board 40 or flat cable, a connection portion 24 adapted to be connected to a board or substrate, a fixed portion 42 to be fixed to a housing 12*a*, an elastic portion 34 and a fulcrum portion 32 provided between the contact portion 22 and the connection portion 24, and a pressure receiving portion 20 extending from the elastic portion 34. The connection portion 24 extends from the fulcrum portion 32 in the opposite direction to the pressure receiving portion 20 and in opposition to the contact portion 22. The contact portion 22, the elastic portion 34, the fulcrum portion 32 and the connection portion 24 are arranged in the form of U-shape.

The "H-shaped" contact 14*b* includes an upper contact portion 22, a pressure receiving portion 20, an elastic portion 34, a fulcrum portion 32, a connection portion 24 extending from the fulcrum portion 32 in the opposite direction to the pressure receiving portion 20 and in opposition to the contact portion 22 and an extension portion 44 extending from the fulcrum portion 32 in the opposite direction to the connection portion 24. A lower contact portion 22 is provided midway of the connection portion 24 so as to be in opposition to the upper contact portion as shown in FIGS. 6A and 6B. The contact portions 22 are formed in the form of a projection to facilitate the contacting with a flexible printed circuit board 40 or flat cable. Although the connection portions 24 are shown of a surface mounting type (SMT) in this embodiment shown in FIG. 5, it will be apparent that they may be of a dip type.

Similarly to the contact 14, with the contact 14*b* when a flexible printed circuit board 40 or flat cable is inserted into the connector 10*a*, the slider 16*a* is pivotally moved so as to pivotally move its urging portions 36 in the space between the pressure receiving portions 20 of the contacts 14*b* and the housing 12*a* or between the pressure receiving portions 20 and the extension portions 44 to raise the pressure receiving portions 20 by the urging portions 36 so that the elastic portions 34 of the contacts 14*b* are tilted about the fulcrum portions 32 as the center of the tilting movement, whereby the contact portions 22 are forced against the flexible printed circuit board 40 or flat cable. The fulcrum portion 32, the elastic portion 34 and the pressure receiving portion 20 are suitably designed particularly on their sizes and shapes so as to perform their functions.

It is preferable to provide a projection 26 at the distal end of the pressure receiving portion 20 of the contact 14*b* for preventing the slider 16*a* from being deformed at its center in the direction shown by an arrow C in FIG. 6B due to strong reaction against the pivotal movement of the slider 16*a* when the urging portion 36 of the slider 16*a* is pivotally moved. In consideration of the strength of the slider somewhat enhanced by the narrower pitches accomplished by the arrangement of the alternately staggered contacts, however, it will be sufficient to provide the projections 26 only on the contacts of one kind among the two kind contacts. The projection 26 may be formed in any size so long as it can perform its function and may be so designed that the urging portion 36 of the slider 16*a* securely engages the projection 26.

Figure 7A:
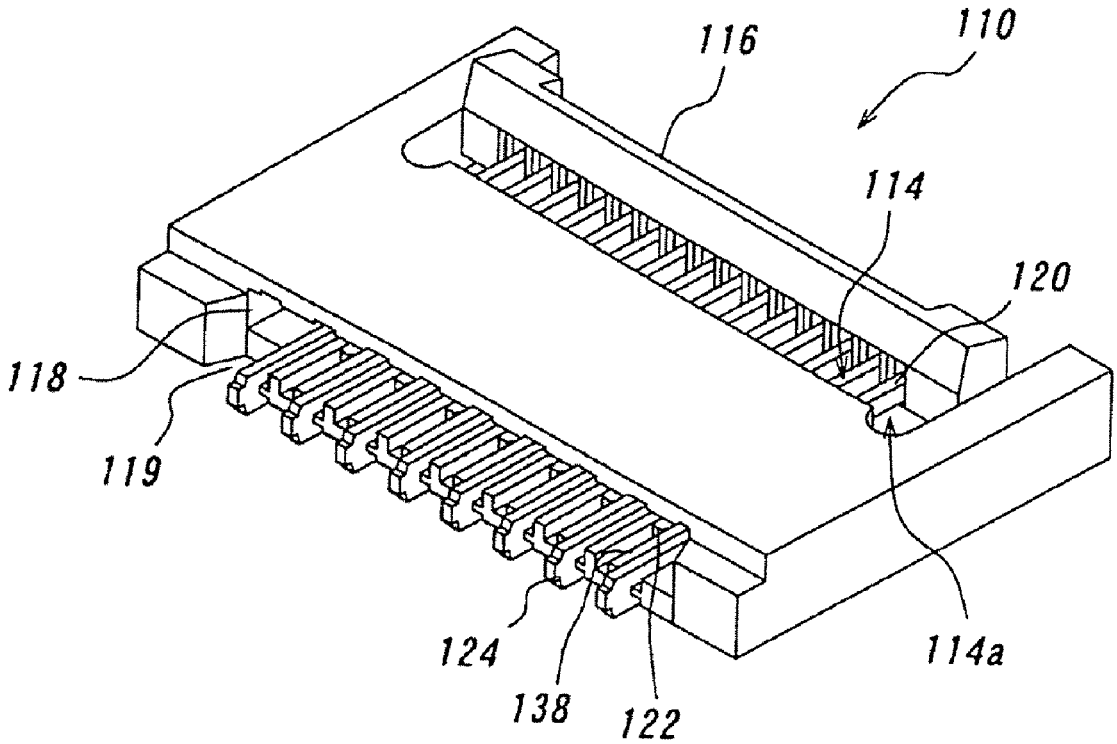
FIG. 7A is a perspective view of a connector achieving the second object of the invention with its slider in the opened condition viewed from the insertion opening.
Figure 7B:
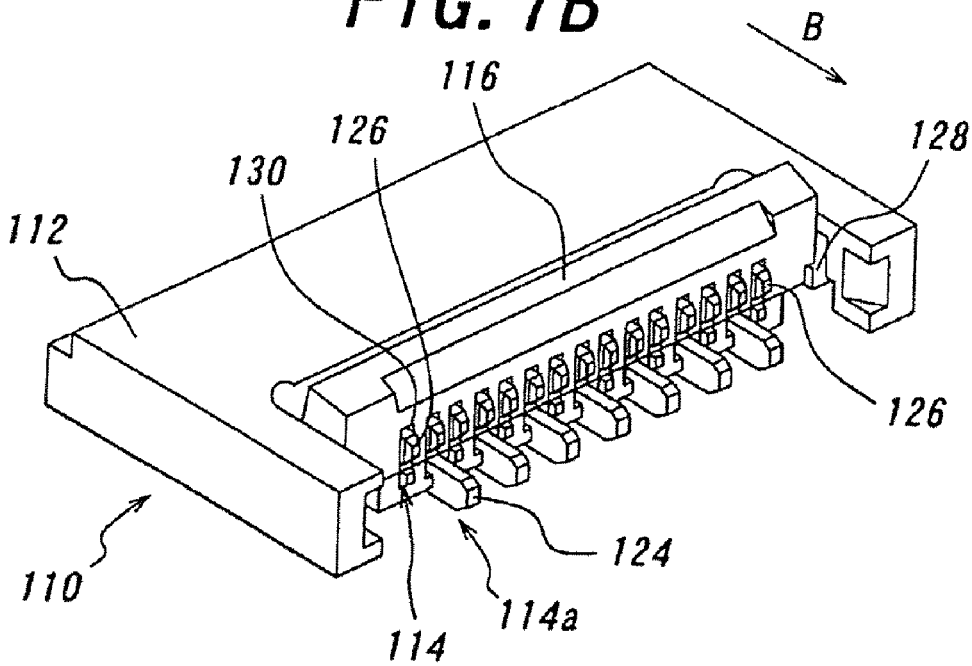
FIG. 7B is a perspective view of the connector shown in FIG. 7A with its slider in the opened condition viewed from the connection portions of contacts.

A connector 110 according to the second aspect of the invention will be explained with reference to FIGS. 7 to 9. The connector 110 mainly composed of a housing 112, a slider 116 and contacts 114 and 114*a*. In the embodiment, the contacts 114 and 114*a* are inserted into the housing 112 from different directions, respectively, and arranged to be alternately staggered in the housing 112, thereby achieving narrower pitches of the contacts and minimizing the height of the connector.

The housing 112 will be explained, which is a subject matter of the second aspect of the invention. The housing 112 is formed with insertion grooves 138 in which a required number of contacts are inserted and fixed thereat by press-fitting, lancing, welding or the like. The housing 112 is formed with a recessed portion 119 for conducting or guiding a flexible circuit board 140 or flat cable into the housing on the same side of an insertion opening for inserting the board or cable. The size of the recessed portion 119 may be suitably designed so that no contacting portions 124 of the contacts extend from the recessed portion 119 of the housing 112 in consideration of the strength of the housing 112, soldability (connecting property) of the contacts 114 and 114*a* and guidance for the flexible printed circuit board 140. In the housing, there are provided bearings for the slider 116 and anchoring portions, which are similar to those in the previous embodiments.

Figure 8A:
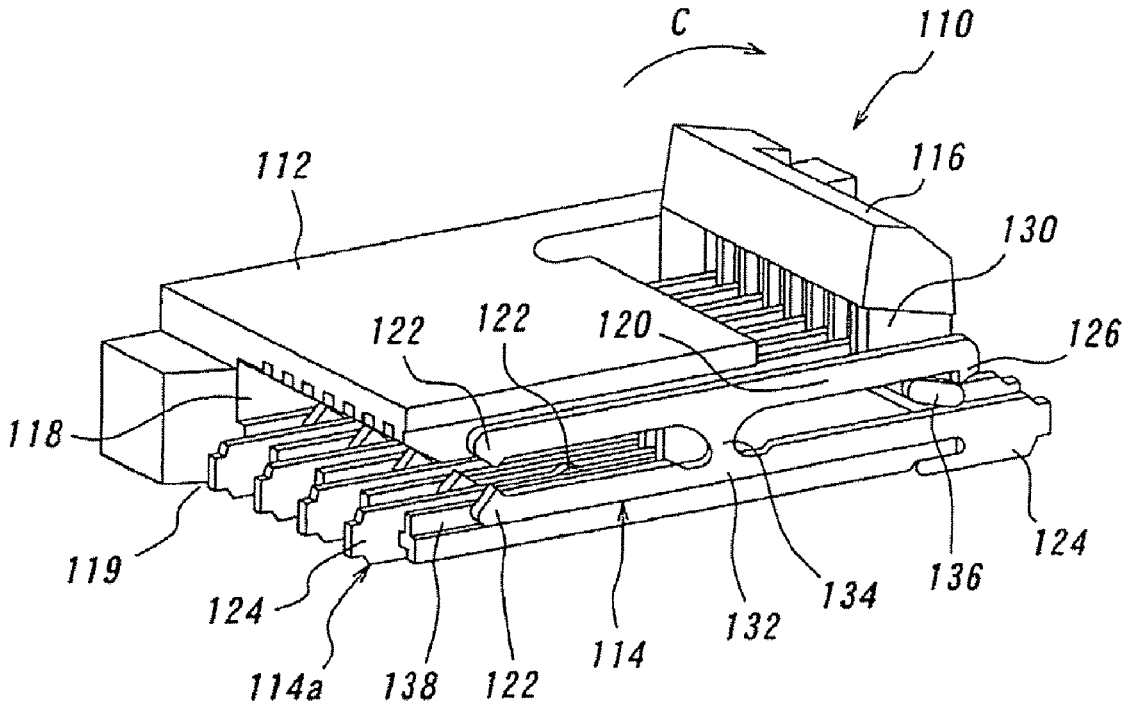
FIG. 8A is a perspective view of the connector shown in FIG. 7A partly cut away along one contact with its slider in the open condition.
Figure 8B:
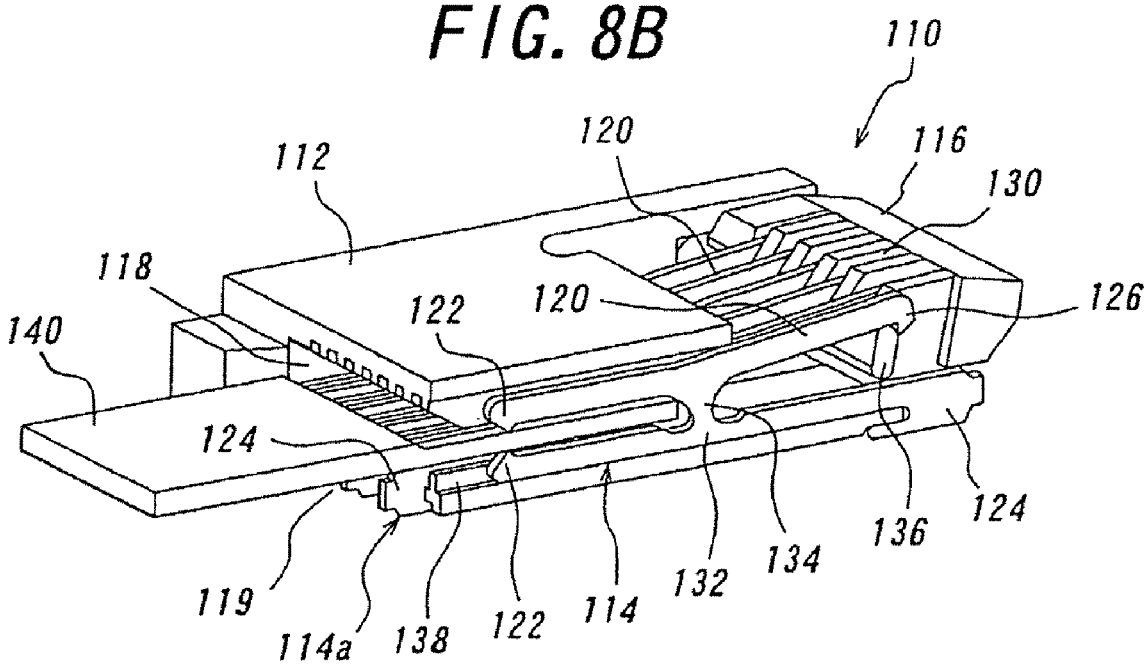
FIG. 8B is a perspective view of the connector shown in FIG. 7A partly cut away along one contact with a flexible printed circuit board inserted therein with the slider in the closed condition.

The two kinds of the contacts 114 and 114*a* will be explained. The contact 114 is "H-shaped" substantially similar to the contact 14 in the previous embodiment shown in FIG. 4A and as shown in FIGS. 8A and 8B mainly composed of an upper contact portion 122 adapted to contact a flexible printed circuit board or flat cable, a connection portion 124 adapted to be connected to a board or substrate, a fixed portion 142 to be fixed to the housing 112, an elastic portion 134 and a fulcrum portion 132 provided between the upper contact portion 122 and the connection portion 124, a pressure receiving portion 120 positioned in opposition to the connection portion 124 and extending from the elastic portion 124, and a lower contact portion 122 extending from the fulcrum portion 132 and positioned in opposition to the upper contact portion 122 to embrace therebetween the flexible printed circuit board 140 or flat cable. The contact 114 will not be described in further detail, since its other configurations are substantially similar to the contact 14 described with reference to FIG. 4A.

After the circuit board 140 or flat cable has been inserted into the housing 112, by pivotally moving the slider 116 the its urging portion 136 is pivotally moved so as to urge the pressure receiving portions 120 of the contacts 114 upward, thereby urging the contact portions 122 of the contacts 114 against the circuit board 140 or flat cable. In such an operation, projections 126 of the pressure receiving portions 120 of the contacts 114 are engaged with the anchoring grooves 130 of the slider 116 to prevent it from being deformed. These functions are the same as in the embodiments of the first aspect of the invention.

Figure 9A:
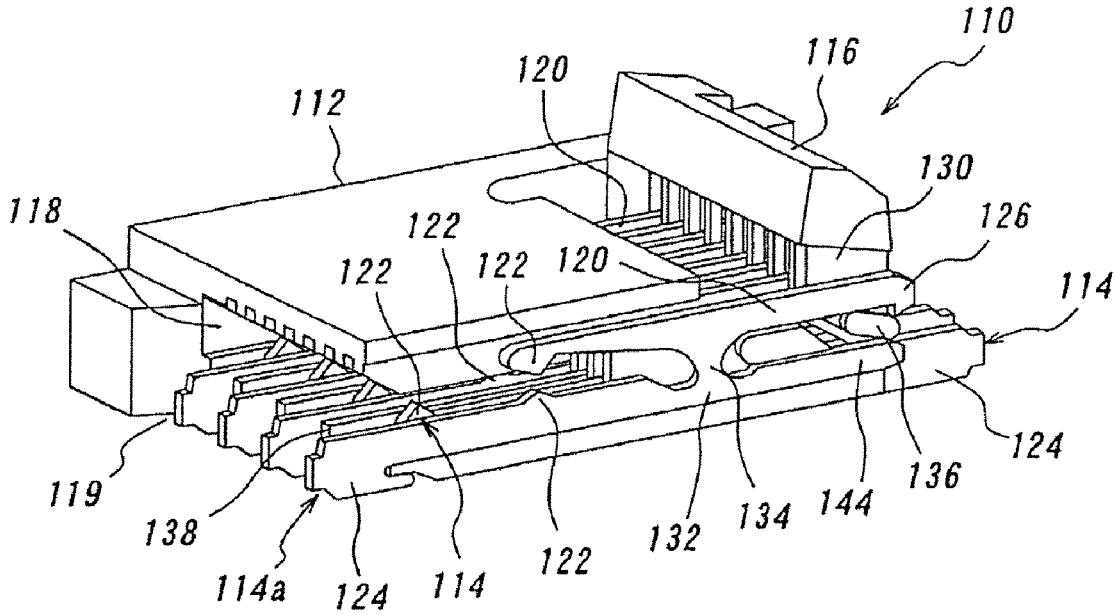
FIG. 9A is a perspective view of the connector shown in FIG. 7A partly cut away along the other contact with its slider in the open condition.
Figure 9B:
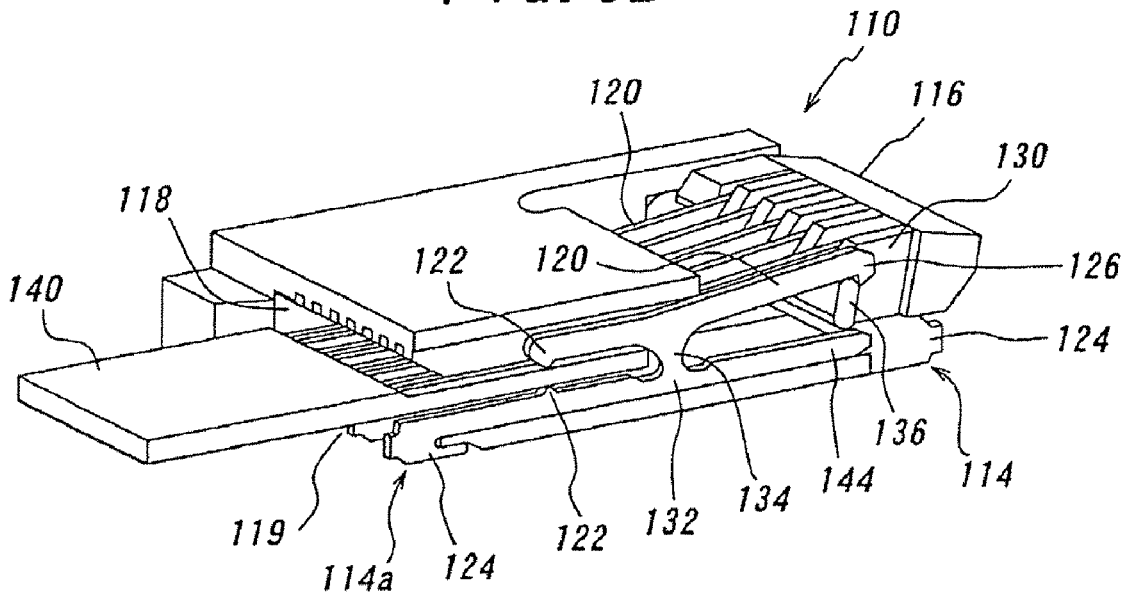
FIG. 9B is a perspective view of the connector shown in FIG. 7A partly cut away along the other contact with a flexible printed circuit board inserted therein with the slider in the closed condition.
Figure 10:
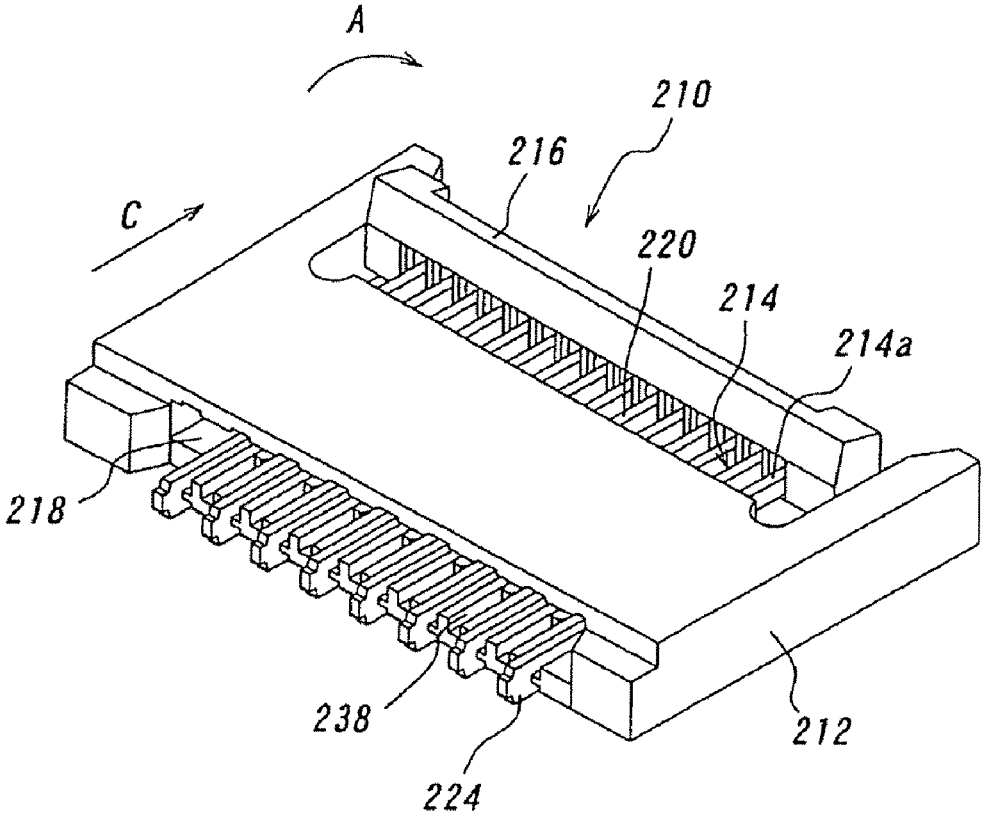
FIG. 10 is a perspective view of a connector achieving the third object of the invention.

Another contact 114*a* will be explained concerning only the different features from the contact 114. The contact 114*a* is also "H-shaped" and as shown in FIGS. 9A and 9B, mainly composed of an upper contact portion 122 adapted to contact a flexible printed circuit board 140 or flexible flat cable, a connection portion 124 adapted to be connected to a board or substrate, a fixed portion 142 to be fixed to the housing 112, an elastic portion 134 and a fulcrum portion 132 provided between the contact portions 122 and the connection portion 124, a pressure receiving portion 120 extending from the elastic portion 134, and an extension portion 144 extending from the fulcrum portion 132 in the opposite direction to the connection portion 124. A lower contact portion 122 is provided midway of the connection portion 124 so as to be in opposition to the upper contact portion 122. The upper contact portion 122, the elastic portion 134, the fulcrum portion 132 and the connection portion 124 are arranged in the form of a U-shape. Likewise, although the connection portion 124 is shown of a surface mounting type (SMT), it will be apparent that it may be of a dip type.

Similar to those of the previous embodiment described above are the fact that by rotating the slider 116 the pressure receiving portions 120 of the contacts 114 or 114*a* are raised upward to firmly clamp the flexible printed circuit board 140 or flat cable between the upper and lower contact portions 122 and the fact that projections 126 preferably provided at the distal ends of the pressure receiving portions 120 of the contacts to prevent the slider 116 from being deformed. In consideration of the strength of the slider somewhat enhanced by the narrower pitches, however, it will be sufficient to provide the projections 126 only on the contacts 114 among the two contacts 114 and 114*b*.

In this embodiment, instead of the contacts 114, the contacts 14*a* not having the lower contact portions 22 shown in FIG. 4B may be used. Also, instead of the contacts 114*a*, "h-shaped" contacts not having the extension portion 144 may be used. In this "h-shaped" contact, the upper contact portion, the elastic portion, the fulcrum portion, and the connection portion are arranged in a U-shape.

The slider 116 will not be described in further detail since the slider 116 is substantially the same as the slider 16 in the previous embodiments described above.

A connector 210 according to the third aspect of the invention will be explained with reference to FIGS. 10 to 13. The connector 210 mainly comprises a housing 212, a slider 216 and contacts 214 and 214*a*.

Figure 12:
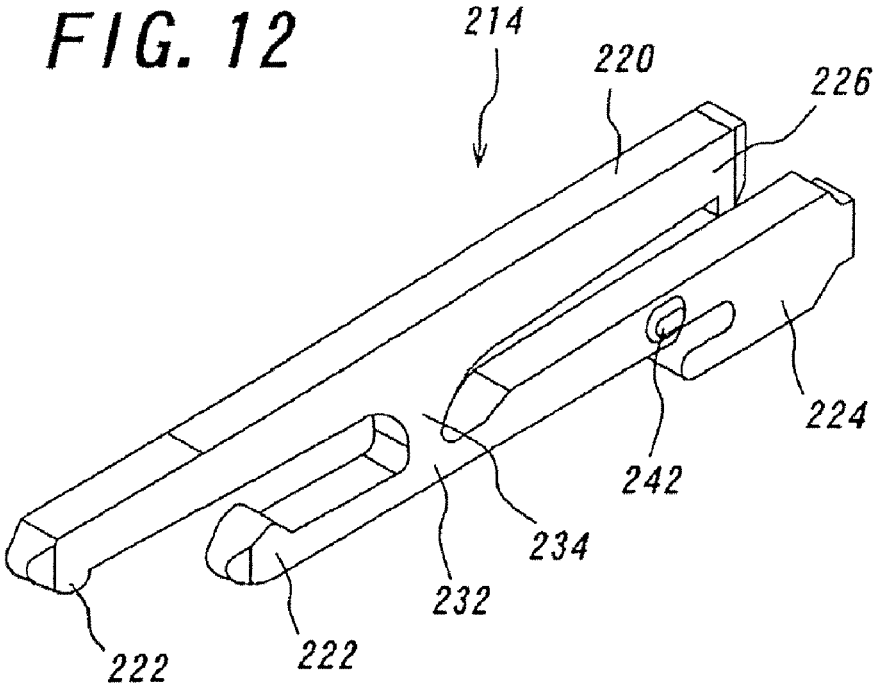
FIG. 12 is a perspective view of the contact of one kind shown in FIG. 11.

The contact 214 is substantially "H-shaped" as shown in FIG. 12 which is mainly composed of an upper contact portion 222 adapted to contact a flexible printed circuit board or flat cable, a connection portion 224 adapted to be connected to a board or substrate, a fixed portion 242 to be fixed to the housing 212, an elastic portion 234 and a fulcrum portion 232 provided between the contact portions 222 and the connection portion 224, a pressure receiving portion 220 positioned in opposition to the connection portion 224 and extending from the elastic portion 234, and a lower contact portion 222 extending from the fulcrum portion 232 and adapted to contact the flexible printed circuit board or flat cable.

In this case, free ends of the upper and lower contact portions 222 are not facing to each other. The upper contact portion 222, the elastic portion 234, the fulcrum portion 232 and the connection portion 224 are arranged in the form of a crank. The upper and lower contact portions have at their free ends projections to facilitate the contacting with the flexible printed circuit board or flat cable. The upper and lower contact portions 222 of the contacts 214 can embrace therebetween a circuit board or flat cable, thereby ensuring reliable contact therebetween. Although the connection portion 224 is shown of a surface mounting type (SMT), it will be apparent that it may be of a dip type.

The flexible printed circuit board or flat cable is clamped between the upper and lower contact portions 222 of the contacts 214 with the aid of the pressure receiving portions 220 raised by the pivotal movement of the slider 216, and the projections 226 provided at the distal ends of the pressure receiving portions 220 of the contacts 214 can prevent the slider 216 from being deformed when it is being pivotally moved. These functions are quite similar to those in the previous embodiments described above.

Figure 13:
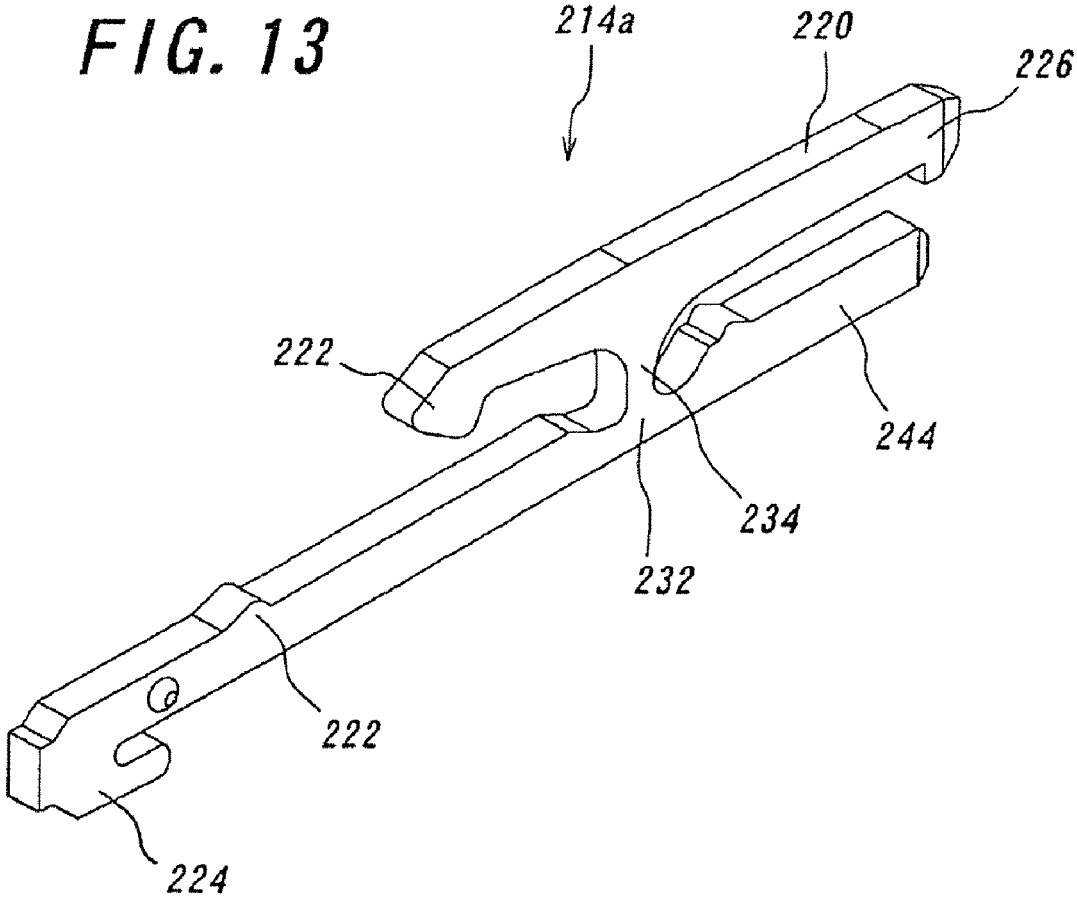
FIG. 13 is a perspective view of the contact of the other kind shown in FIG. 11.
Figure 14A:
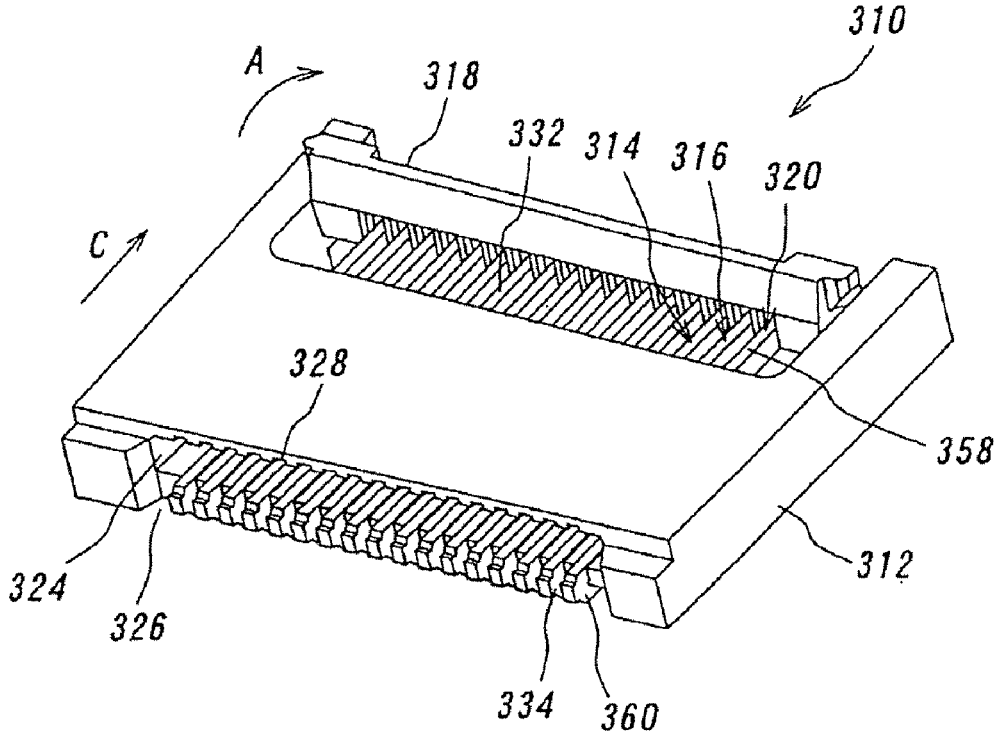
FIG. 14A is a perspective view of a connector achieving the forth object of the invention with its slider in the opened condition, viewed from the insertion opening of the housing.
Figure 14B:
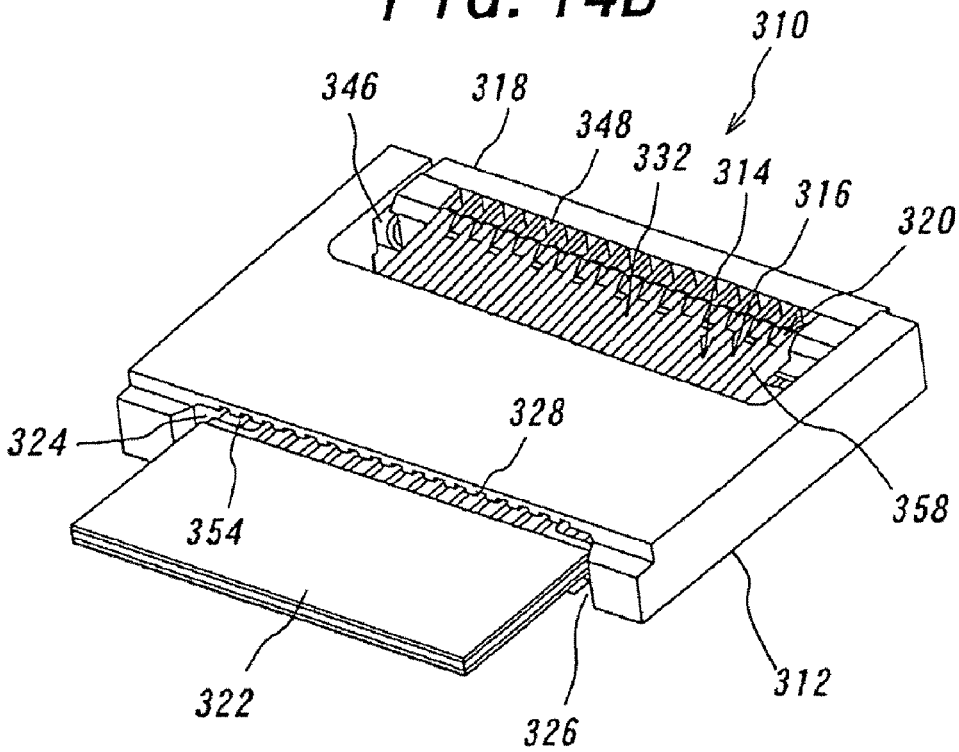
FIG. 14B is a perspective view of the connector shown in FIG. 14A with its slider in the opened condition, viewed from the opposite side of the insertion opening.
Figure 15A:
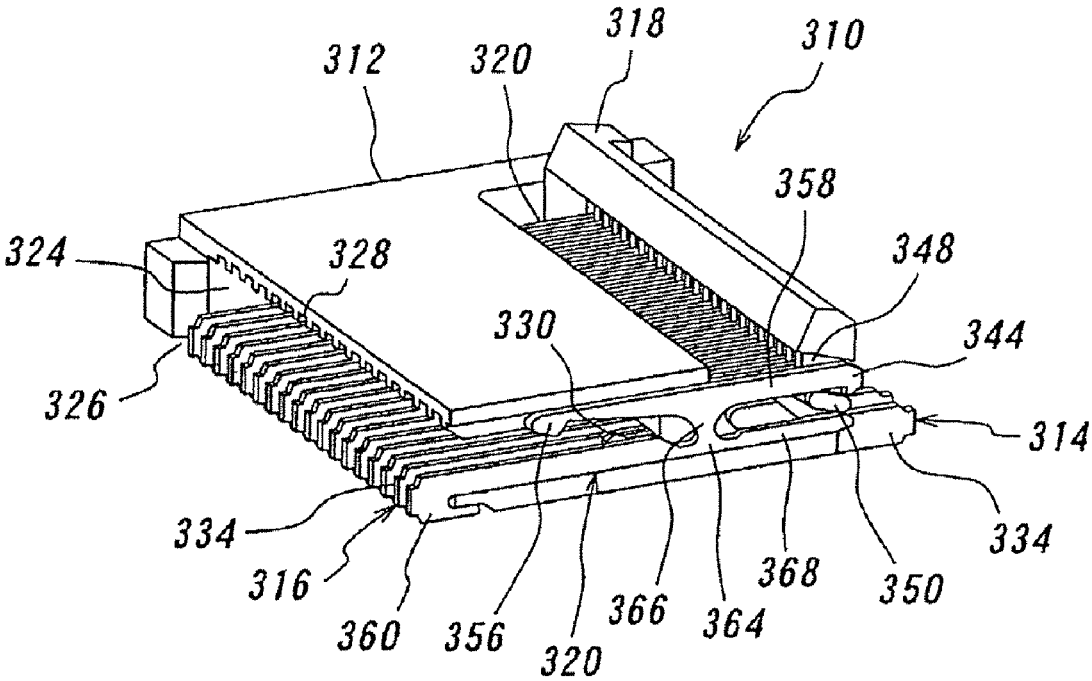
FIG. 15A is a perspective view of the connector shown in FIG. 14A partly cut away along a locking member with the slider in the opened condition.
Figure 15B:
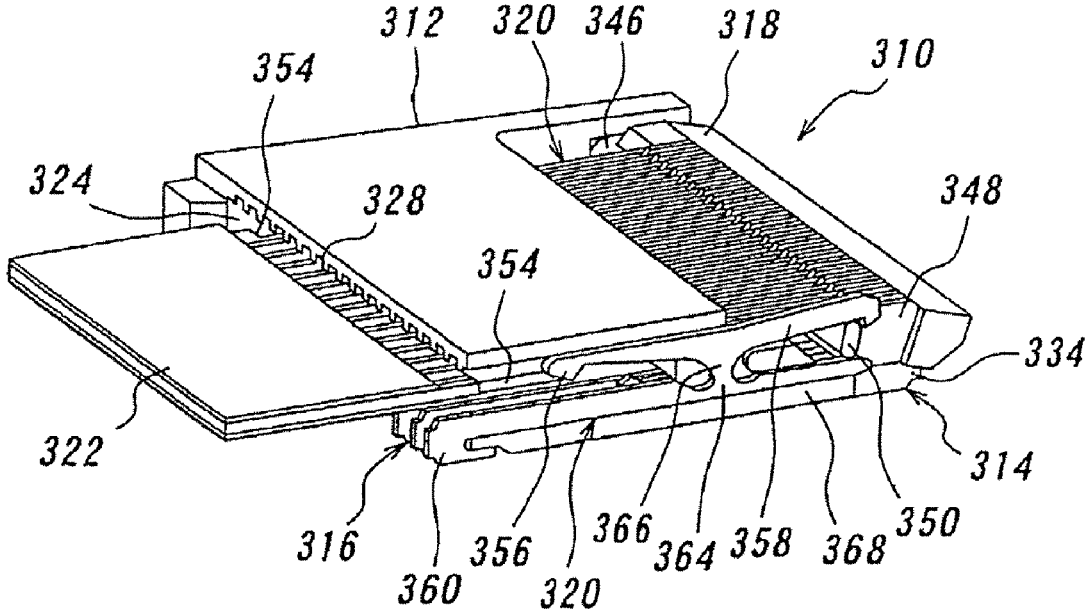
FIG. 15B is a perspective view of the connector shown in FIG. 14A partly cut away along the locking member with the slider in the closed condition with a flexible printed circuit board inserted therein.
Figure 16:
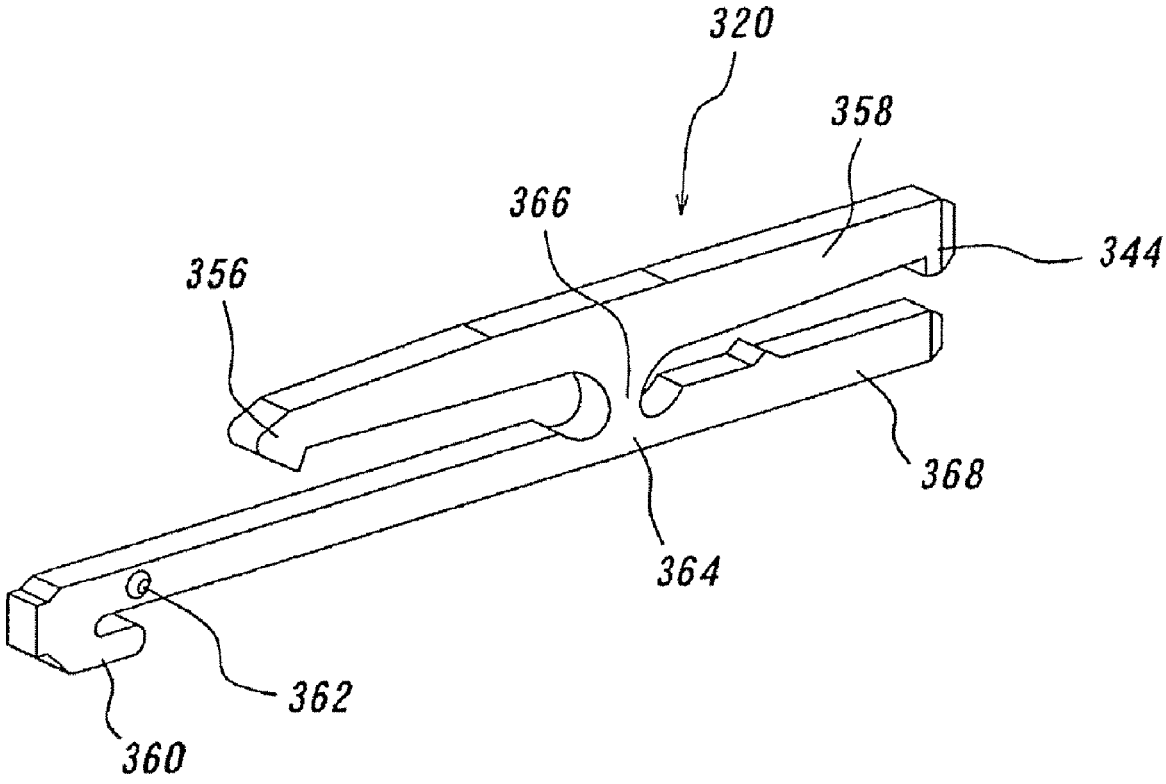
FIG. 16 is a perspective view of the locking member used in FIG. 15A.

FIG. 13 illustrates another contact 214*a* in this embodiment which will be explained with only different features from the contact 214. The contact 214*a* is also "H-shaped" as shown in FIG. 13, and is mainly composed of an upper contact portion 222 adapted to contact a flexible printed circuit board or flat cable, a connection portion 224 adapted to be connected to a board or substrate, a fixed portion 242 to be fixed to the housing 212, an elastic portion 234 and a fulcrum portion 232 provided between the contact portion 222 and the connection portion 224, a pressure receiving portion 220 extending from the elastic portion 234, an extension portion 244 extending in the opposite direction to the connection portion 224, and a lower contact portion 222 provided on the way from the fulcrum portion 232 to the free end of the connection portion 224. In the embodiment shown in FIG. 13, the upper and lower contact portions 222 are not in opposition to each other. The upper contact portion 222, the elastic portion 234, the fulcrum portion 232 and the connection portion 224 including the lower contact portion 222 are arranged in the form of a U-shape. The connection portion 224 is of a surface mounting type (SMT), but it may be of a dip type.

The flexible printed circuit board or flat cable is clamped between the contact portions 222 of the contacts 214*a* by the action of the pressure receiving portions raised by the rotation of the slider 216, and the projections 226 are provided on the pressure receiving portions 220 of the contacts 214*a* to prevent the slider 216 from being deformed. These functions are quite the same as those in the previous embodiments described above. In consideration of the strength of the slider somewhat enhanced by the narrower pitches, however, it will be sufficient to provide the projections 226 only on the contacts 214 among the two contacts 214 and 214*b*.

Figure 11:
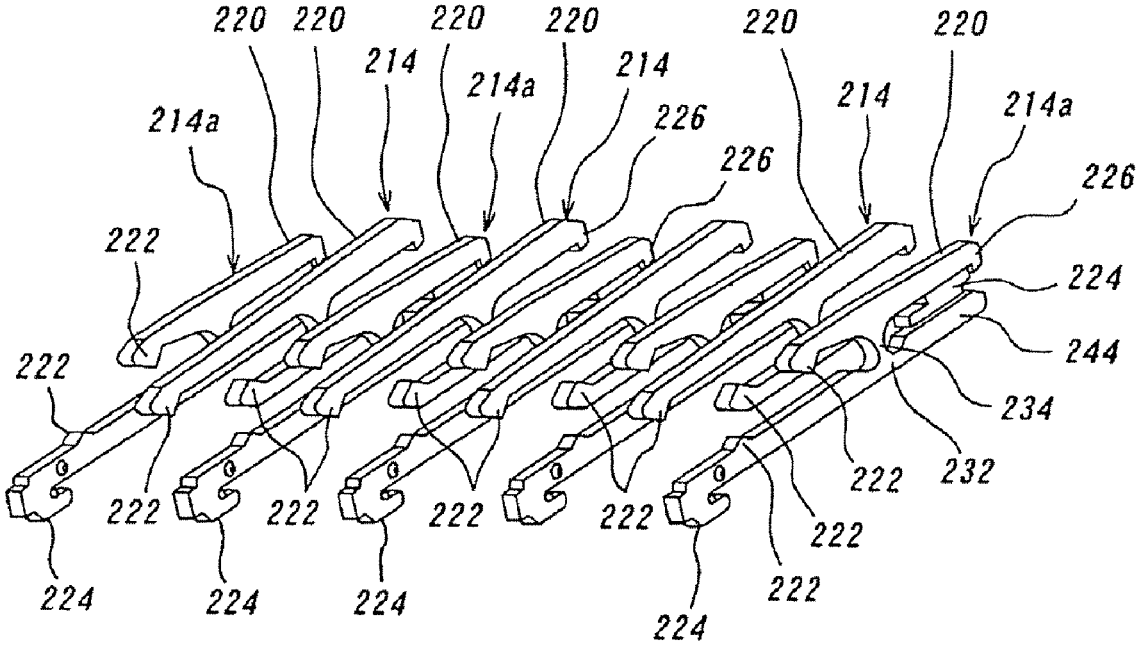
FIG. 11 is a perspective view illustrating an arrangement of contacts of two kinds used in the connector shown in FIG. 10.

The contacts 214 and 214*a* in this embodiment are adapted to embrace a flexible printed circuit board with their contact portions forming U-shaped frames, respectively. Corresponding to the arrangement of contacts alternately staggered on the flexible printed circuit board, the contact portions 222 of the contacts 214 and 214*a* are arranged staggered in upper and lower relations. In order to miniaturize the connector, when these contacts are installed in the housing 212, the contacts 214 are inserted into the housing 212 from its rear side or connection portion side and the contacts 214*a* are inserted into the housing 212 from its front side or insertion opening side so that the contacts 214 and 214*a* are arranged alternately staggered as shown in FIG. 11.

The housing 212 in this embodiment will not be explained in further detail since this is substantially the same in construction as the housing 112 of the second aspect of the invention shown in FIGS. 8A and 8B and 9A and 9B. The housing 12 in the first aspect of the invention may be used in this embodiment, if the insertion grooves 38 are provided at locations corresponding to the positions of the insertion grooves 238 for installing the contacts 214 and 214*a*. Moreover, the slider 216 in this embodiment will not be explained in further detail because it is substantially the same in construction as the slider 16 in the first aspect of the invention.

A connector 310 according to the forth aspect of the invention will be explained with reference to FIGS. 14 to 19. The connector 310 mainly comprises a housing 312, a slider 318, contacts 314 and 316 and locking members 320. According to the forth aspect of the invention, the contacts 314 and 316 are arranged alternately staggered in the housing 314 by inserting the contacts 314 and 316 from different directions into the housing 314 to achieve narrower pitches of the contacts and to minimize the height of the connector 310, and the locking members 320 are used to enhance the force holding a flexible printed circuit board 322.

Figure 17A:
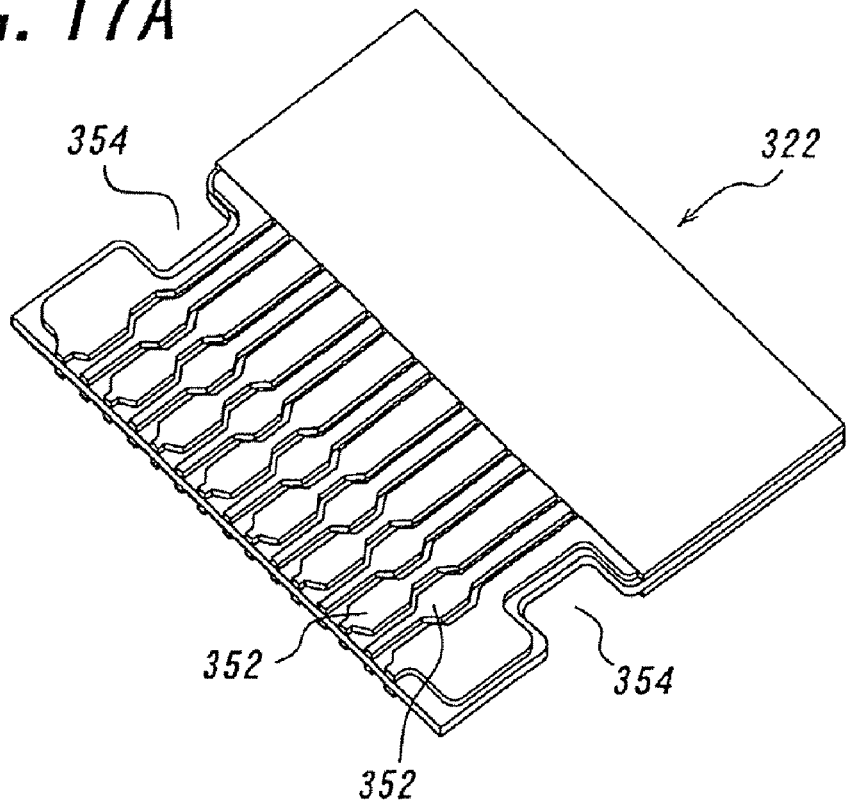
FIG. 17A is a perspective view of part of a flexible printed circuit board used in the connector shown in FIG. 15A.
Figure 17B:
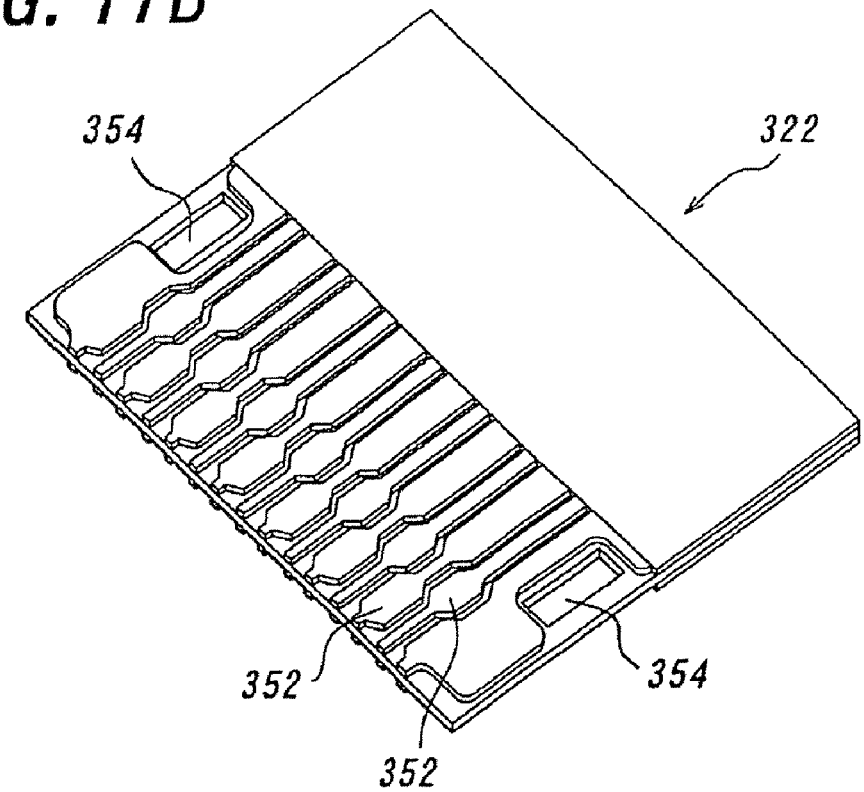
FIG. 17B is a perspective view of part of a flexible printed circuit board of another embodiment.
Figure 18A:
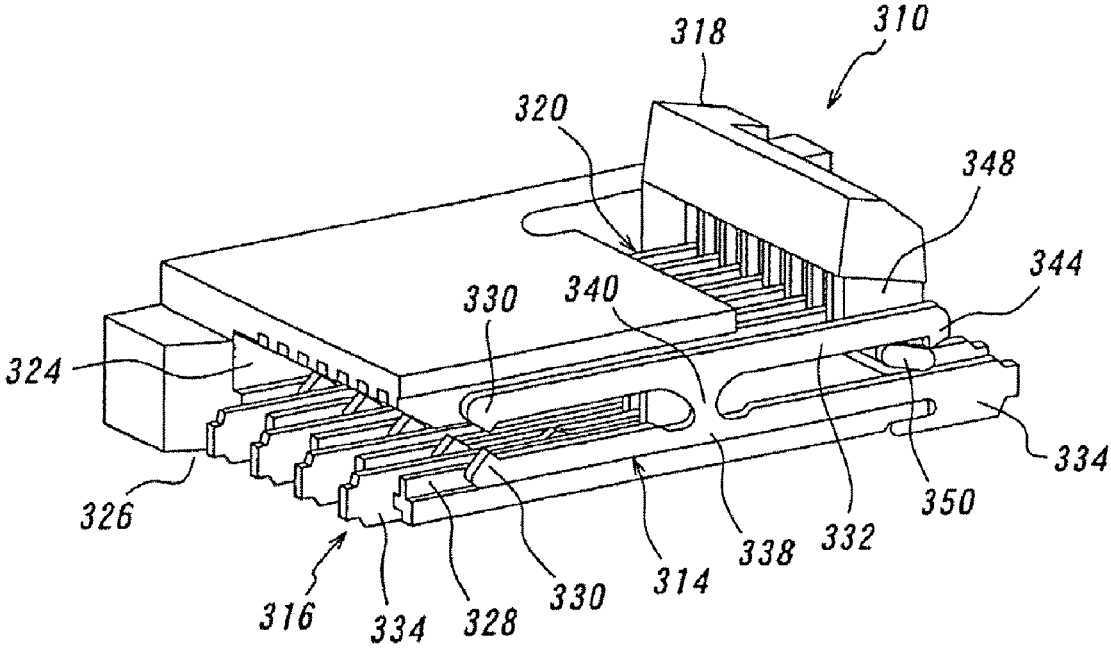
FIG. 18A is a perspective view of the connector shown in FIG. 15A partly cut away along a contact of one kind with the slider in opened condition.
Figure 18B:
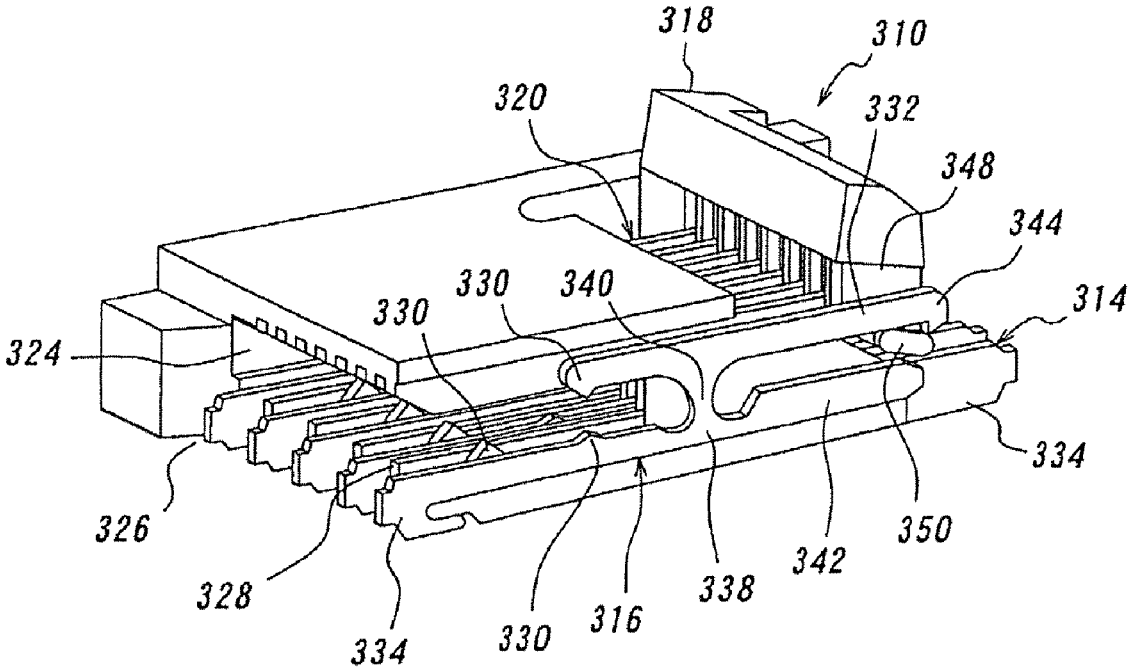
FIG. 18B is a perspective view of the connector shown in FIG. 15A partly cut away along a contact of the other kind with the slider in opened condition.
Figure 19:
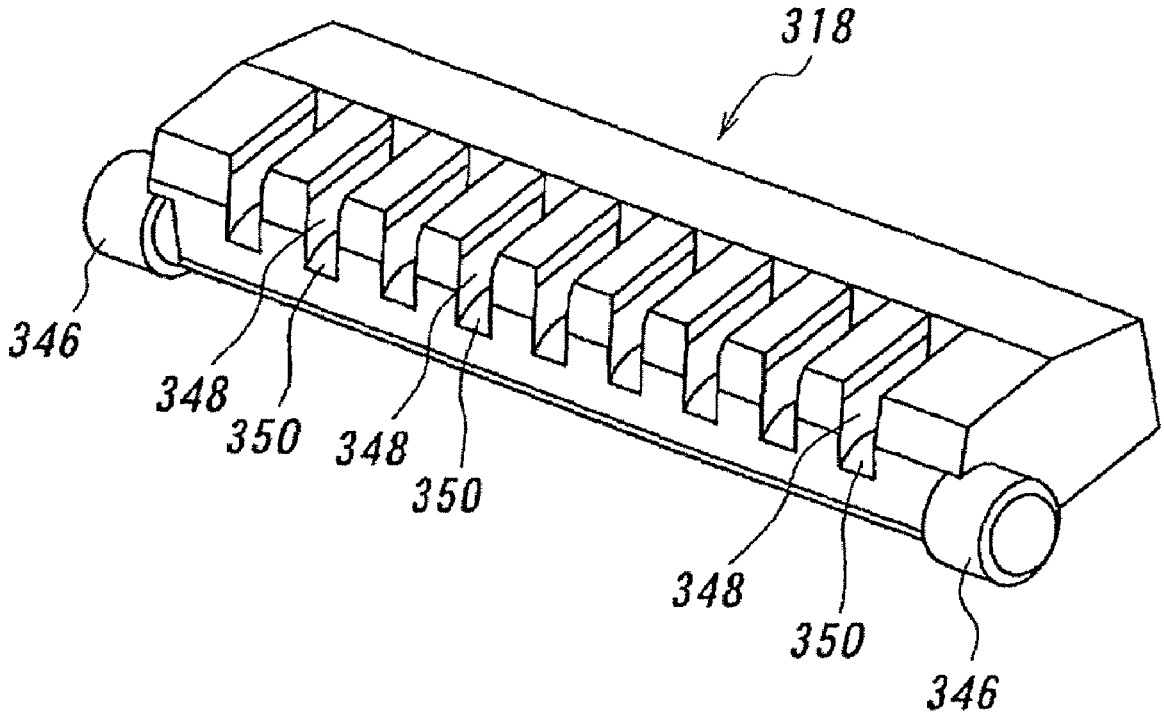
FIG. 19 is a perspective view of the slider used in this embodiment.
Figure 20A:
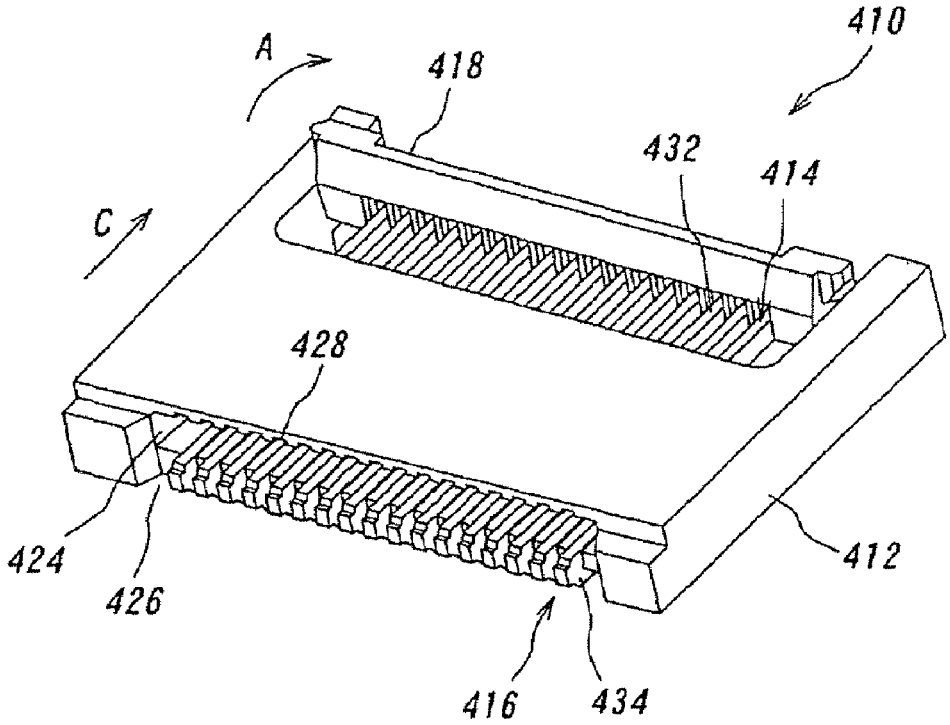
FIG. 20A is a perspective view of a connector achieving the fifth object of the invention with its slider opened, viewed from the insertion opening of the housing.
Figure 20B:
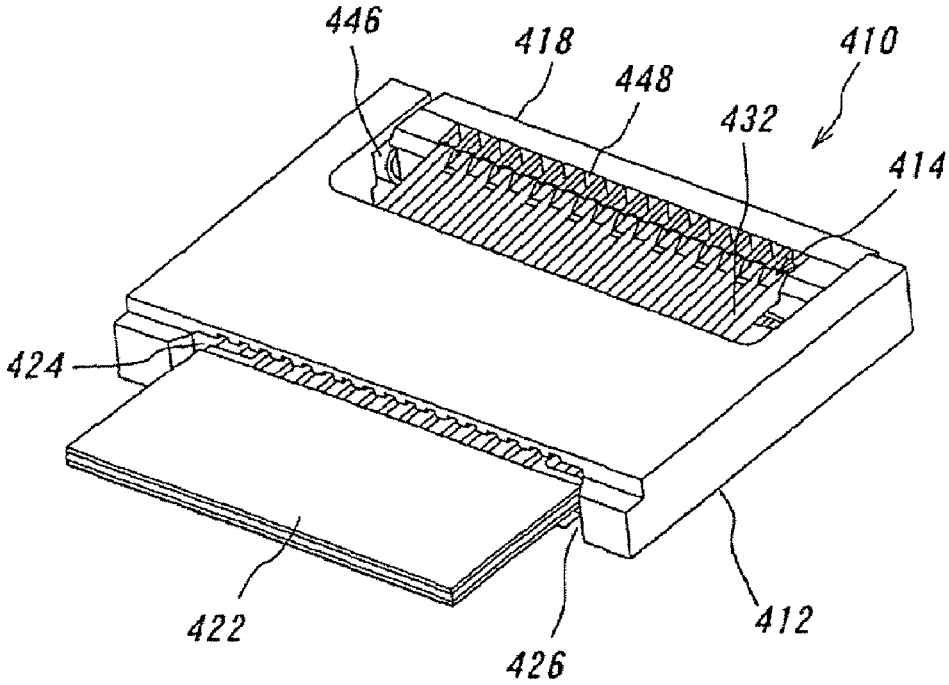
FIG. 20B is a perspective view of the connector shown in FIG. 20A with its slider closed with a flexible printed circuit board inserted therein, viewed from the insertion opening of the housing.
Figure 21A:
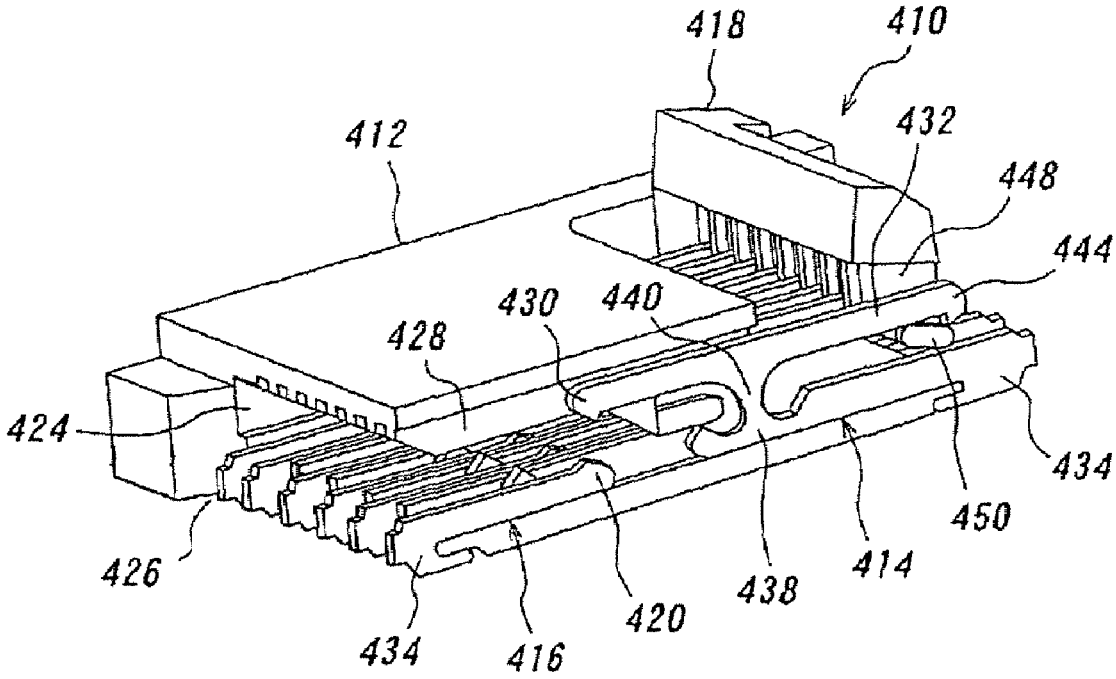
FIG. 21A is a perspective view of the connector shown in FIG. 20A partly cut away along a contact with the slider opened.
Figure 21B:
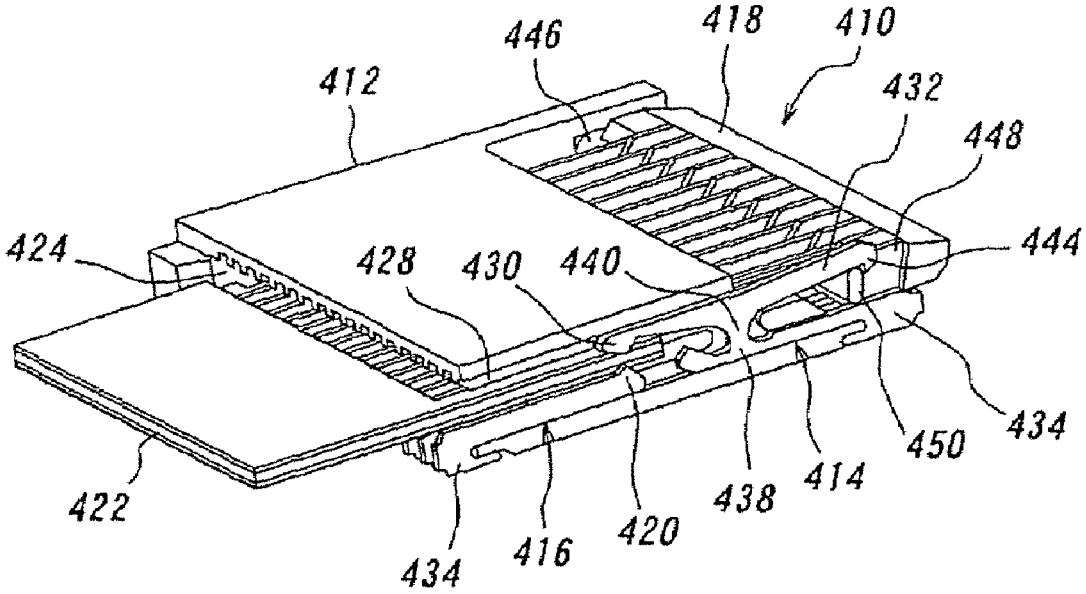
FIG. 21B is a perspective view of the connector shown in FIG. 20A partly cut away along the contact with the slider closed with the flexible printed circuit board inserted therein.
Figure 22A:
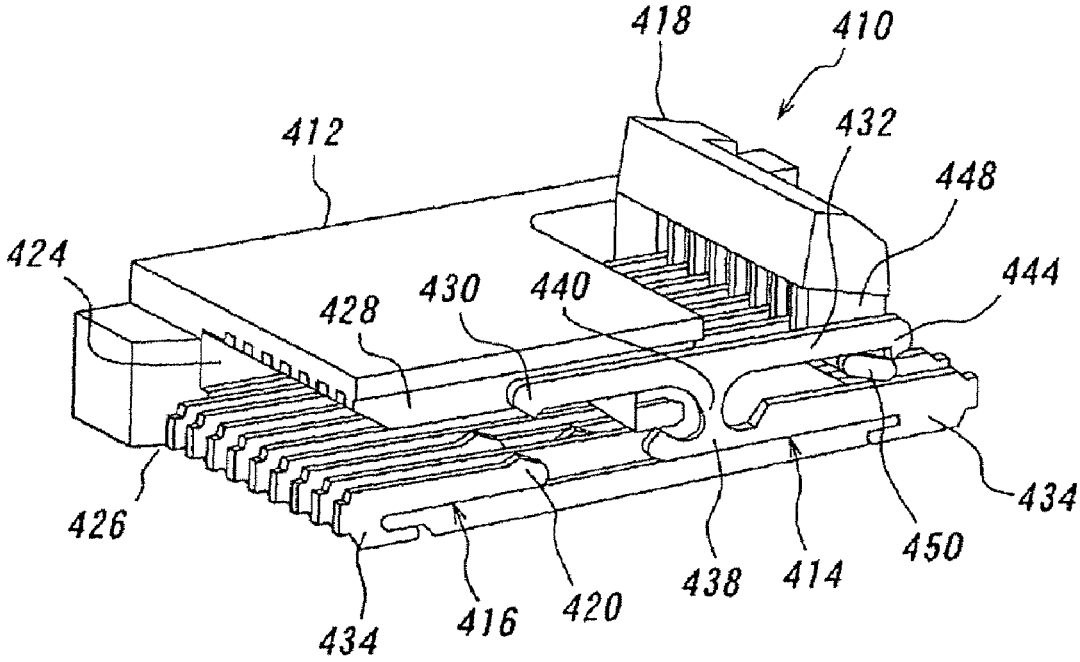
FIG. 22A is a perspective view of the connector partly cut away along the contact other than that of FIG. 21A with the slider opened in the case of a flexible printed circuit board having contact portions arranged alternately staggered.
Figure 22B:
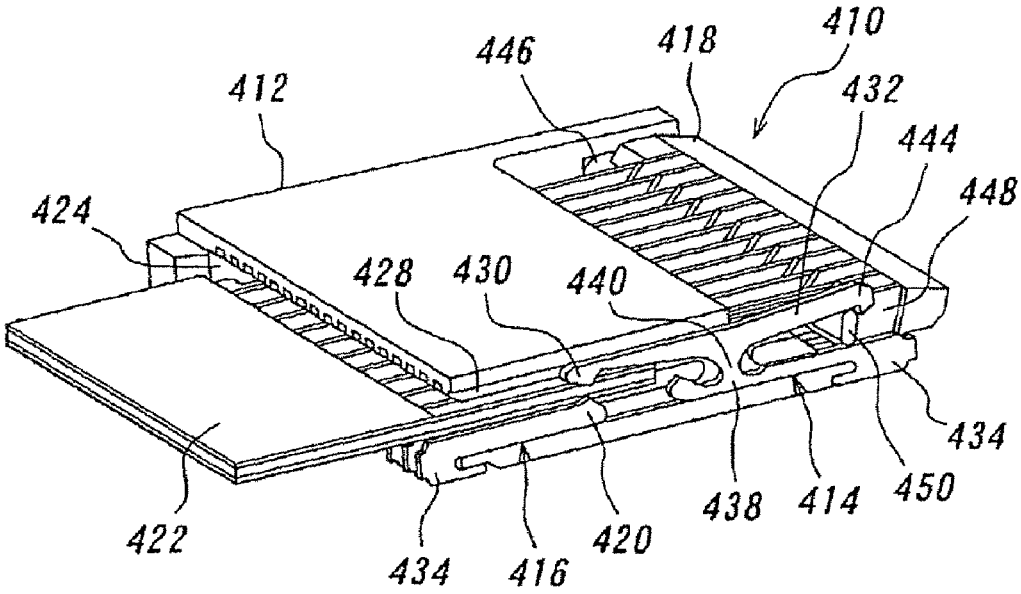
FIG. 22B is a perspective view of the connector partly cut away along the contact other than that of FIG. 21B with the slider closed in the case of the circuit board having contact portions arranged alternately staggered.

The flexible printed circuit board 322 will be explained before explanation of the respective components of the connector 310. Referring to FIGS. 17A and 17B, the flexible printed circuit board 322 comprises contact portions 352 adapted to contact respective contact portions 330 of the contact 314 and 316, patterns connecting the contact portions 352 to circuits, and anchoring portions 354 adapted to engage engaging portions 356 of the locking portions 320. As shown in FIGS. 17A and 17B, in this embodiment the contact portions 352 of the flexible printed circuit board 322 are arranged alternately staggered thereon. The anchoring portions 354 may be formed in any shape so long as they can engage the engaging portions 356 of the locking members 320. In this embodiment, the anchoring portions 354 are rectangular notches as shown in FIG. 17A or rectangular through-holes 354 as shown in FIG. 17B.

The locking members 320 will be explained which is a subject mater of this aspect of the invention. The locking members 320 are made of a metal and formed by the press-working in the conventional manner. Preferred materials from which to form the locking members 320 include brass, beryllium copper, phosphor bronze and the like to fulfil the requirements imposed thereon, springiness, formability and the like.

In this embodiment, the locking member 320 is "H-shaped" similar to the contact 316 and mainly composed of an engaging portion 356 adapted to engage the anchoring portion 354 of the flexible printed circuit board 322, a connection portion 360 to be connected to a board or substrate, a fixed portion 362 to be fixed to the housing 312, an elastic portion 366 and a fulcrum portion 364 provided between the engaging portion 356 and the connection portion 360, a pressure receiving portion 358 extending from the elastic portion 366, and an extension portion 368 extending from the fulcrum portion 364 in the opposite direction to the connection portion 360. The engaging portion 356, the elastic portion 366, the fulcrum portion 364 and the connection portion 360 are arranged in the form of a U-shape. In this embodiment, the connection portion 360 is of a surface mounting type (SMT), but may be of a dip type. The functions and effects of the elastic portion 366, the fulcrum portion 364, the pressure receiving portion 358 and the extension portion 368 of the locking member 320 are substantially the same as those of the contacts having the shape similar to the locking member 320.

The locking members 320 are fixed to the housing 312 by press-fitting, lancing or the like with their connection portions 360 being on the side of the insertion opening 324 of the housing 312 such that the engaging portions 356 of the locking members 320 are positioned correspondingly to and engageable with the anchoring portions 354 of the flexible printed circuit board 322. The engaging portion 356 is suitably designed on its size sufficient to obtain the required holding force. The shape of the engaging portion 356 may be in any shape insofar as it can engage the anchoring portion 354 of the flexible printed circuit board 322. In this embodiment, the engaging portion 356 is substantially in the form of a "right angled triangle" whose vertical surface is adapted to contact one side surface of the rectangular anchoring portion 354 of the flexible printed circuit board in consideration of the holding force.

In this embodiment, when the flexible printed circuit board 322 is inserted into the insertion opening 324 of the housing 312, the engaging portion 356 of the locking member 320 does not engage the anchoring portion 354 of the flexible printed circuit board 322, but only when the circuit board 322 are urged against the contacts 314 and 316 by the slider 318, the engaging portion 356 will engage the anchoring portion 354 of the circuit board 322.

The housing 312 will then be explained. The housing 312 is formed with insertion grooves 328 in which a required number of contacts 314 and 316 are inserted and fixed thereat by press-fitting, lancing, welding or the like. The housing 312 is further provided with an insertion opening 324 into which a flexible printed circuit board 322 is inserted, and is provided on the same side with a recessed portion 326 for conducting the flexible printed circuit board 322. The size of the recessed portion 326 may be suitably designed so that no connection portions 334 and 360 of the contact 316 and the locking member 320 extend from the recessed portion 326 of the housing 312 in consideration of the strength of the housing 312, soldability of the contact 316 and the locking member 320 and guidance for the flexible printed circuit board 322.

The size of the insertion opening 324 is suitably designed such that the flexible printed circuit board 322 can be inserted into the insertion opening 324 and when the flexible printed circuit board has been inserted into the housing 312, the circuit board, the flexible printed circuit board 322 are forced against the contacts 314 and 316 by the slider 318. The housing 312 is further provided in the proximity of the longitudinal ends with bearings for rotatably supporting axles 346 of the slider 318. The bearings can be formed in any shape and size insofar as the slider 318 can be rotated with its axles supported in the bearings. The bearings are suitably designed in consideration of their function and the strength and size of the housing 312. The housing 312 is further provided at the longitudinal ends with anchoring portions at locations corresponding to the locking portions of the slider 318.

The contacts 314 and 316 of two kinds in the fourth aspect of the invention are substantially the same as the contacts of the two kinds of the second aspect of the invention, and therefore the contacts 314 and 316 will not be described in further detail. Moreover, instead of the contacts 314 and 316, the "h-shaped" contacts used in the first aspect of the invention may be used, which do not have the lower contact portion 22. Moreover, suitable for use as the contacts in this embodiment are "h-shaped" contacts composed of a contact portion adapted to contact the flexible printed circuit board, a connection portion to be connected to a board or substrate, a fixed portion to be fixed to the housing, an elastic portion and a fulcrum portion provided between the contact portion and the connection portion, and a pressure receiving portion extending from the elastic portion. In this case, the contact portion, the elastic portion, the fulcrum portion and the connection portion are arranged substantially in the form of a U-shape.

The slider 316 is substantially similar in construction to the slider 16 in the first aspect of the invention, and therefore the slider 316 will not be described in further detail.

A connector 410 according to the fifth aspect of the invention will be explained with reference to FIGS. 20 to 25. The connector 410 mainly comprises a housing 412, a slider 418 and contacts 414 and 416. In the connector 410, the contacts 414 and 416 are inserted into the housing 412 from different sides and arranged therein to accommodate a flexible printed circuit board having contact portions on its opposite surfaces. In the case of a flexible printed circuit board having on its opposite surfaces contact portions arranged alternately staggered, contacts having contact portions located in positions different from those of the contacts 414 and 416 are used and arranged alternately staggered so as to permit their contact portions to positionally correspond to the contact portions of the flexible printed circuit board.

The flexible printed circuit board 422 will be explained before explanation of the components of the connector 410. The flexible printed circuit board 422 mainly comprises contact portions 452 adapted to contact respective contact portions 430 of the contacts 414 and 416 and patterns connecting the contact portions 452 to circuits. The flexible printed circuit board 422 shown in FIG. 25 includes the contact portions 452 on its opposite surfaces.

The housing 412 in this embodiment is formed with insertion grooves 428 at required positions for fitting a required number of the contacts 414 and 416. The housing 412 will not be described in further detail, because it is substantially the same in construction as the housing 112 in the second aspect of the invention.

Figure 23A:
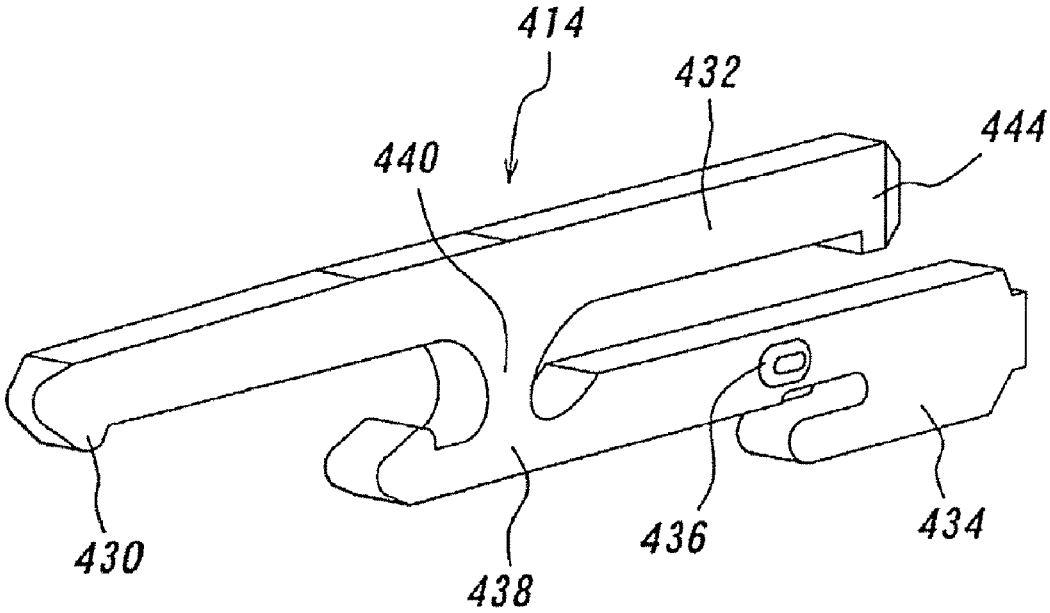
FIG. 23A is a perspective view of a contact of one kind used in this embodiment.

The contacts 414 and 416 of the two kinds will be explained which are one subject matter of the fifth aspect of the invention. The contact 414 is substantially "h-shaped" as shown in FIG. 23A and mainly composed of a contact portion 430 adapted to a flexible printed circuit board 422, a connection portion 434 to be connected to a board or substrate, a fixed portion 436 to be fixed to the housing 412, an elastic portion 440 and a fulcrum portion 438 provided between the contact portion 430 and the connection portion 436, and a pressure receiving portion 432 positioned at a location in opposition to the connection portion 436 and extending from the elastic portion 440. The contact portion 430, the elastic portion 440, the fulcrum portion 38 and the connection portion 434 are arranged in the form of a crank. The contact portion 430 forms a projection to facilitate the contacting with the flexible printed circuit board 422. The connection portion 430 is of a surface mounting type (SMT), but it may be of a dip type. In the illustrated embodiment, the contact portion 430 of the contact 414 will contact a contact portion 452 on the upper or first surface of the flexible printed circuit board 422.

The flexible printed circuit board or flat cable is clamped between the upper and lower contact portions 430 and 420 of the contacts 414 and 416 with the aid of the pressure receiving portions 432 raised by the pivotal movement of the slider 418, and the projections 444 provided at the distal ends of the pressure receiving portions 432 of the contacts 414 can prevent the slider 418 from being deformed when it is being pivotally moved. These functions are quite similar to those in the previous embodiments described above.

Figure 23B:
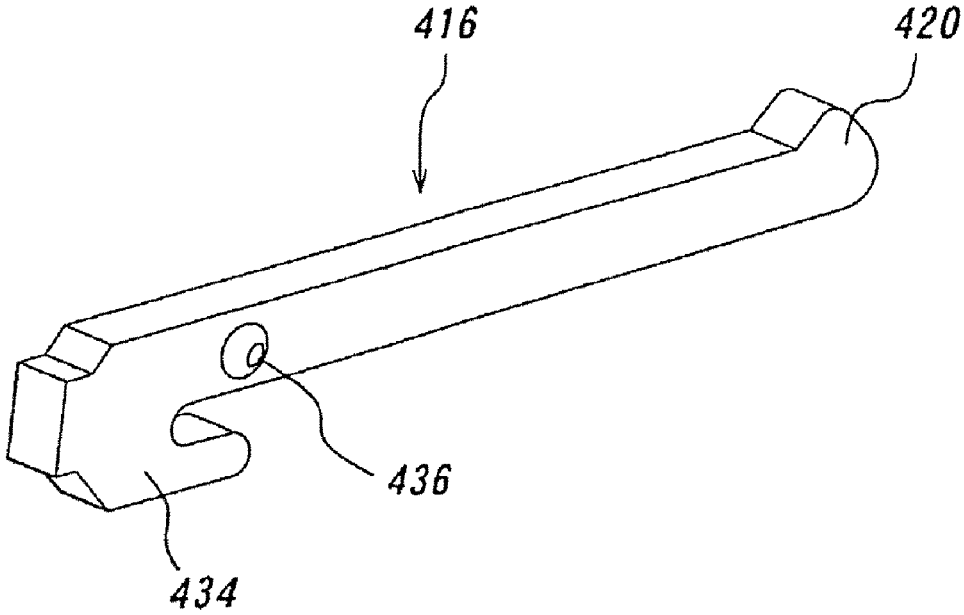
FIG. 23B is a perspective view of a contact of the other kind used in this embodiment.

Another contact 416 will be explained. The contact 416 is substantially I-shaped as shown in FIG. 23B and is mainly composed of a contact portion 420 adapted to contact a flexible printed circuit board 422, a connection portion 434 to be connected to a board or substrate, and a fixed portion 436 to be fixed to the housing 412. The flexible printed circuit board 422 is embraced between the contact portions 420 of the contacts 416 and the contact portions 430 of the contacts 414. Namely, the contact portions 420 of the contacts 416 are brought into contact with the contact portions 452 on the rear surface of the flexible printed circuit board 422.

The contacts 414 and other contacts 416 are arranged in this manner so that the flexible printed circuit board 422 having the contact portions 452 on both the surfaces is embraced between the contacts 414 and the contacts 416, thereby securely bringing the contact portions 430 and 420 of the contacts 414 and 416 into contact with the contact portions 452 on both the surfaces of the flexible printed circuit board 422. The connection portions 434 of the contacts 416 are of a surface mounting type (SMT), but they may be of a dip type.

As can be seen from the above explanation, the contact portions 430 of the contacts 414 are brought into contact with the contact portions 452 on the upper or first surface of the flexible printed circuit board 422 and the contact portions 420 of the contacts 416 are brought into contact with the contact portions 452 on the lower or second surface of the flexible printed circuit board 422. In other words, the contacts 414 and 416 of the two kinds are arranged in pairs each one above the other so that the contact portions 430 and 420 of pairs of the contacts 414 and 416 are arranged in opposition to each other, one above the other, thereby securely embracing the flexible printed circuit board 422 by the pairs of the contacts 414 and 416. The contact portions 430 and 420 of the two kinds of the contacts 414 and 416 are suitably designed in corresponding relation to the contact portions 452 and 452 of the flexible printed circuit board 422.

Figure 24:
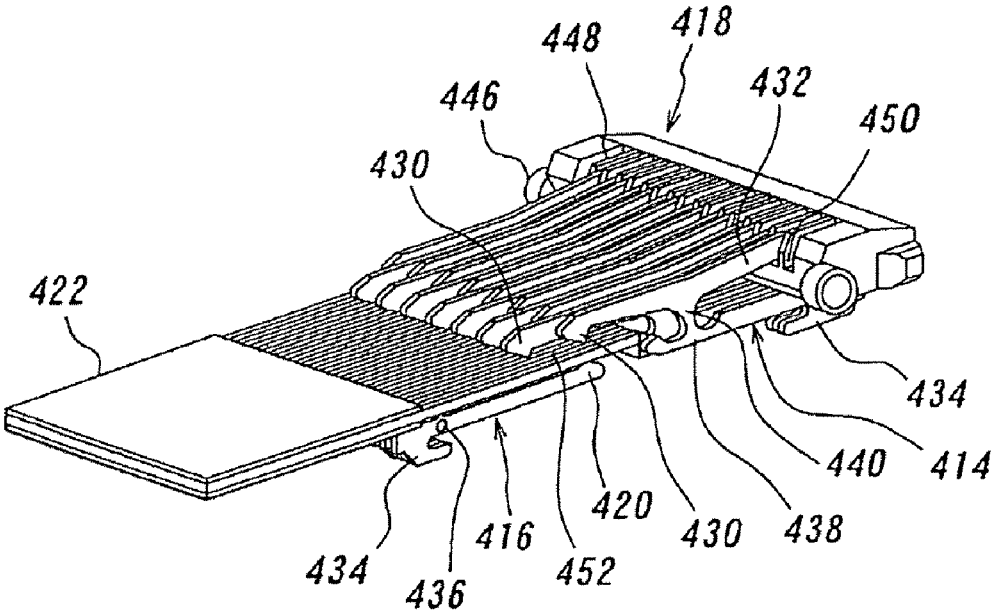
FIG. 24 is a perspective view illustrating the two kind of contacts contacting a flexible printed circuit board in this embodiment.
Figure 25:
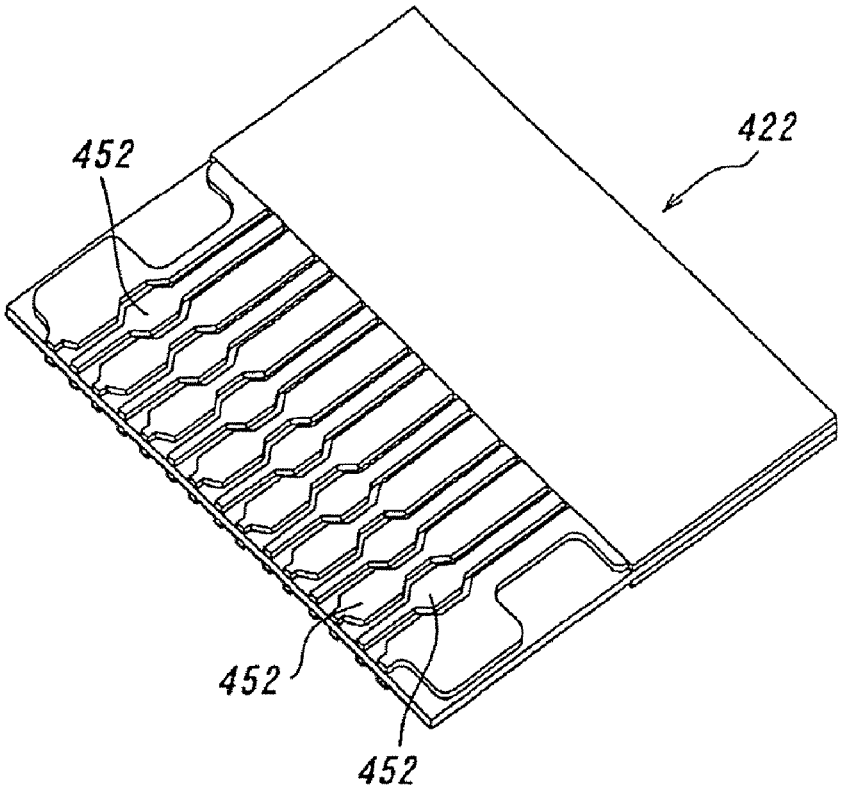
FIG. 25 is a perspective view of part of the printed circuit board.

In the case of a flexible printed circuit board 422 as shown in FIG. 25 having on both the surfaces contact portions 452 arranged alternately staggered, contacts of other type are provided which are different in position of contact portions from the contacts 414 and 416 shown in FIGS. 23A and 23B. These contacts of the other type are brought into contact with the alternately staggered contact portions on the flexible printed circuit board as shown in FIG. 24. In order to vary the locations of the contact portions in the above manner, in the case of the contact 414, the length from the elastic portion 440 to the contact portion 430 is varied and in the case of the contact 416, the length from the fixed portion 436 to the contact portion 420 is varied.

The slider 416 will not be described in further detail, because it is substantially the same in construction as the slider 16 in the first aspect of the invention.

Figure 26A:
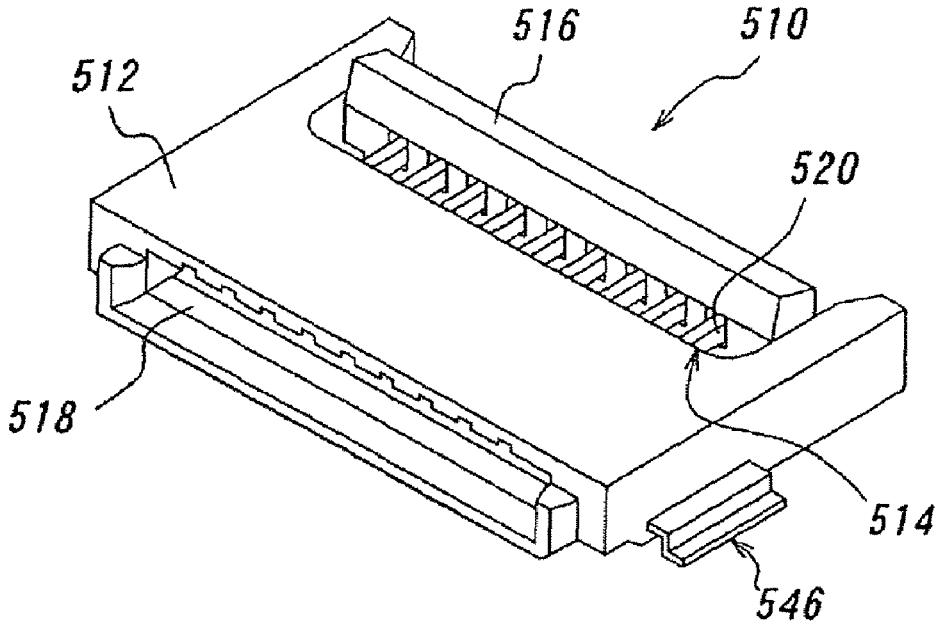
FIG. 26A is a perspective view of a connector achieving the sixth object of the invention with a slider in the opened condition, viewed from the insertion opening of the housing.
Figure 26B:
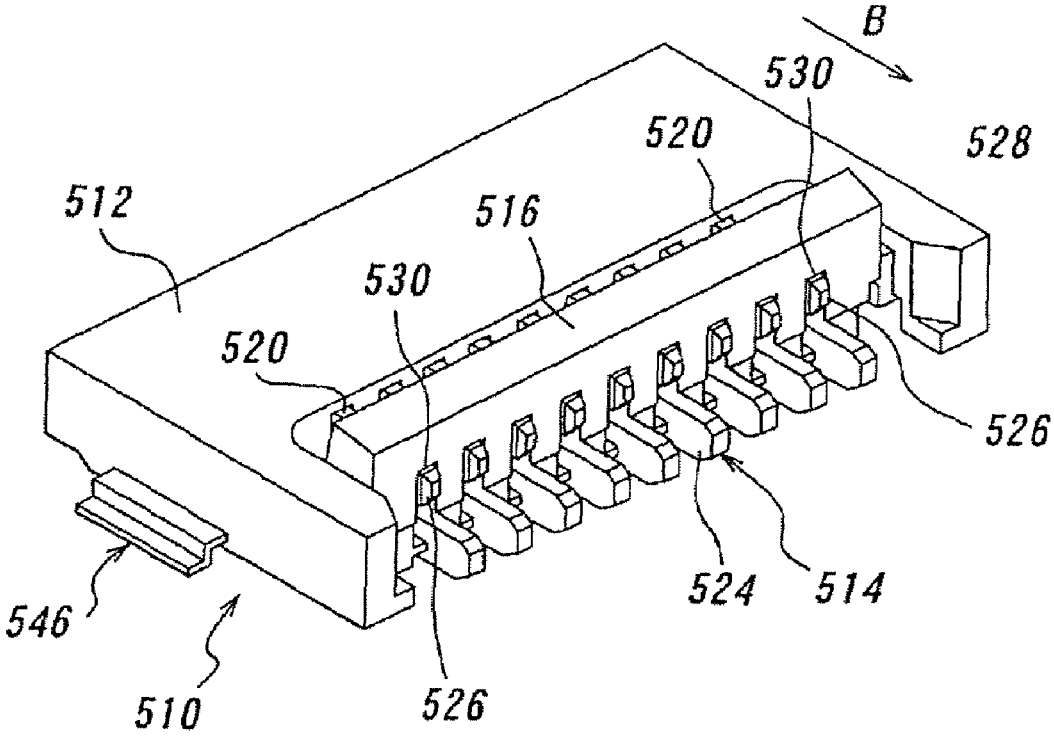
FIG. 26B is a perspective view of a connector achieving the sixth object of the invention with a slider in the opened condition, viewed from the connection portions of contacts.
Figure 27A:
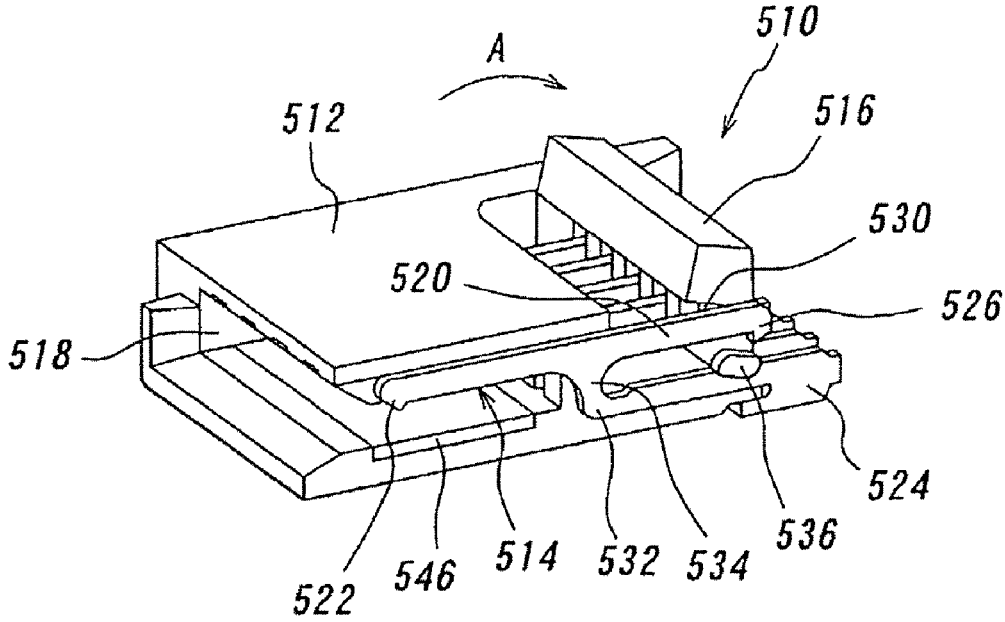
FIG. 27A is a perspective view of the connector shown in FIG. 26A cut away along one contact with the slider opened.
Figure 27B:
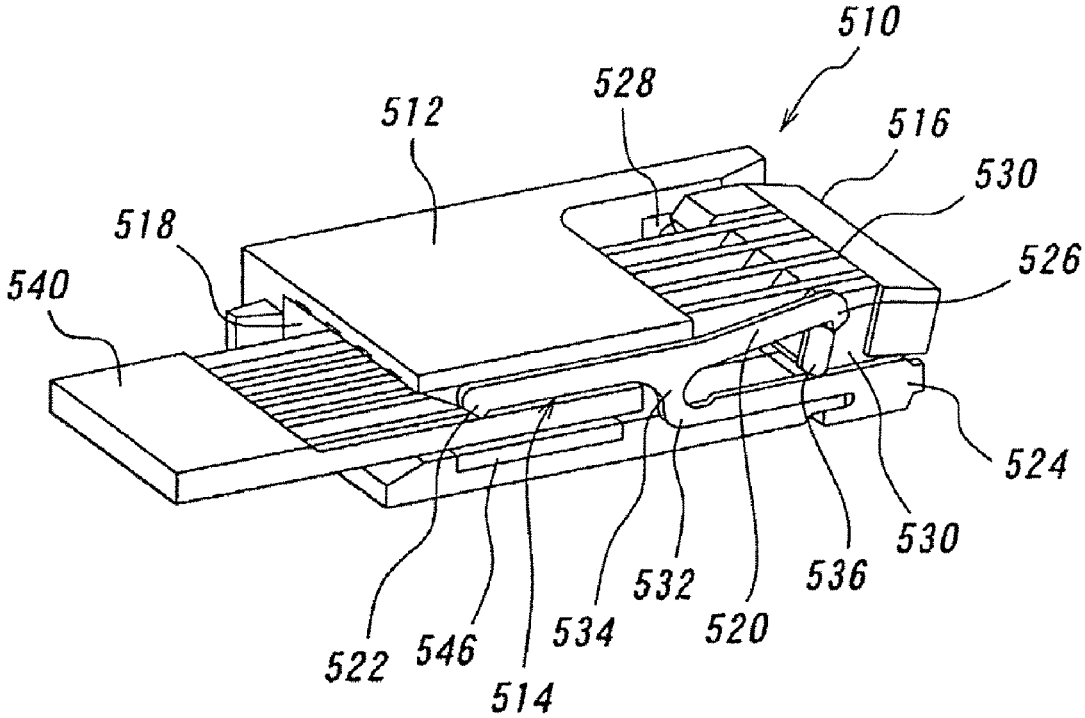
FIG. 27B is a perspective view of the connector shown in FIG. 26A cut away along the one contact with the slider closed with a flexible printed circuit board inserted therein.

A connector 510 according to the sixth aspect of the invention will be explained with reference to FIGS. 26 to 28. The connector 510 mainly comprises a housing 512, a slider 516, contacts 514 and a plate-shaped piece 544 or 546.

First, the plate-shaped piece will be explained which is the subject matter of the sixth aspect of the invention. When the flexible printed circuit board 540 or flat cable is inserted through an insertion opening 518 into the housing 512, the printed circuit board 540 or flat cable is urged downward by a contacting force caused by contact portions 522 of the contacts 514 so that the housing 512 is in turn urged downward. In such a case, the plate-shaped piece 544 or 546 serves to prevent the housing 512 from being deformed.

For the material of the plate-shaped piece 544 or 546, stainless steel is ideal, which is superior in hardness, rigidity and workability (including susceptibility to plating and ability to be worked to thinner) to fulfil the requirement imposed thereon and for the purpose of preventing the housing 512 from being deformed and minimizing the height of the connector 510. The size of the plate-shaped piece 544 or 546 is suitably determined in consideration of its function described above, the number or pitches of the contacts and the like.

The plate-shaped piece 544 or 546 is formed in a thickness of the order of 0.08 to 0.12 mm. If it is less than 0.08 mm, the deformation of the housing 512 cannot be prevented, while if more than 0.12 mm, the minimization in height of the connector 510 cannot be accomplished. The thickness of 0.1 mm is most preferable.

The plate-shaped piece 544 or 546 is fixed in and integrally with the housing 512 with any one of various methods, such as integral forming or insert molding, press-fitting, adhesion, hooking or the like. In the insert molding, the plate-shaped piece 544 or 546 may be completely concealed in the housing or partly exposed out of the housing 512 (for example, at an insertion opening 518 of the housing or on the side of connection portions of the contacts 514).

Figure 28A:
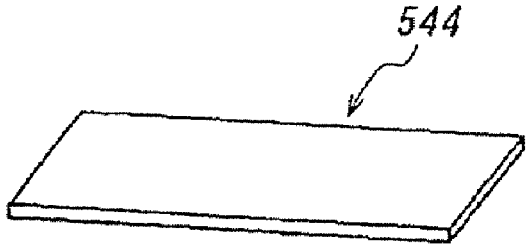
FIG. 28A is a perspective view of an exemplary plate-shaped piece used in this embodiment.
Figure 28B:
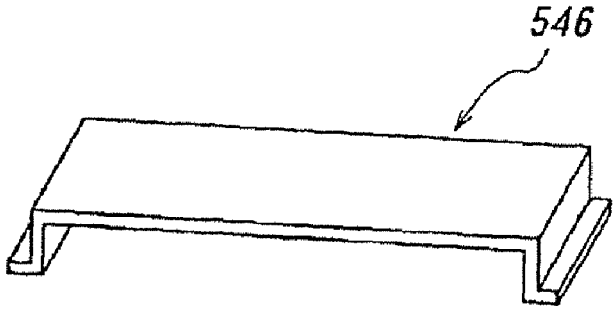
FIG. 28B is a plate-shaped piece of another embodiment.
Figure 29:
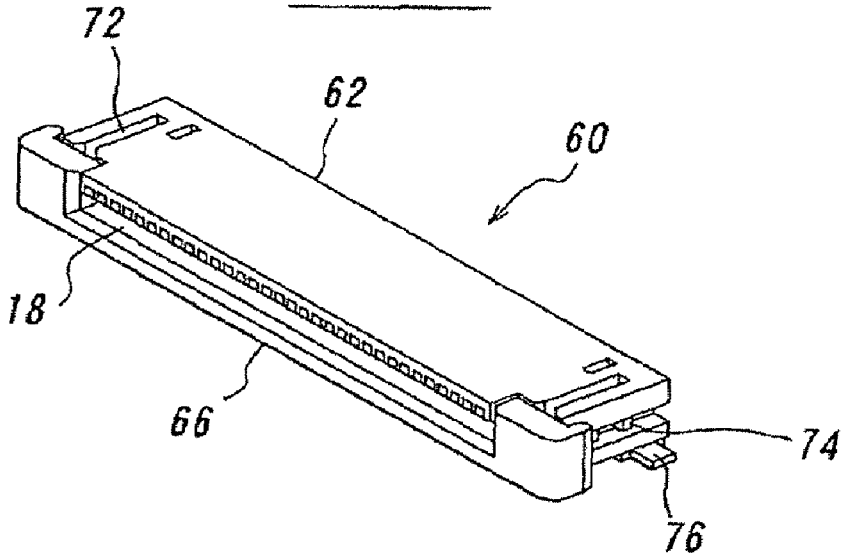
FIG. 29 PRIOR ART
FIG. 29 is a perspective view of a connector of the prior art before a slider is inserted, viewed from the insertion opening of the housing.
Figure 30A:
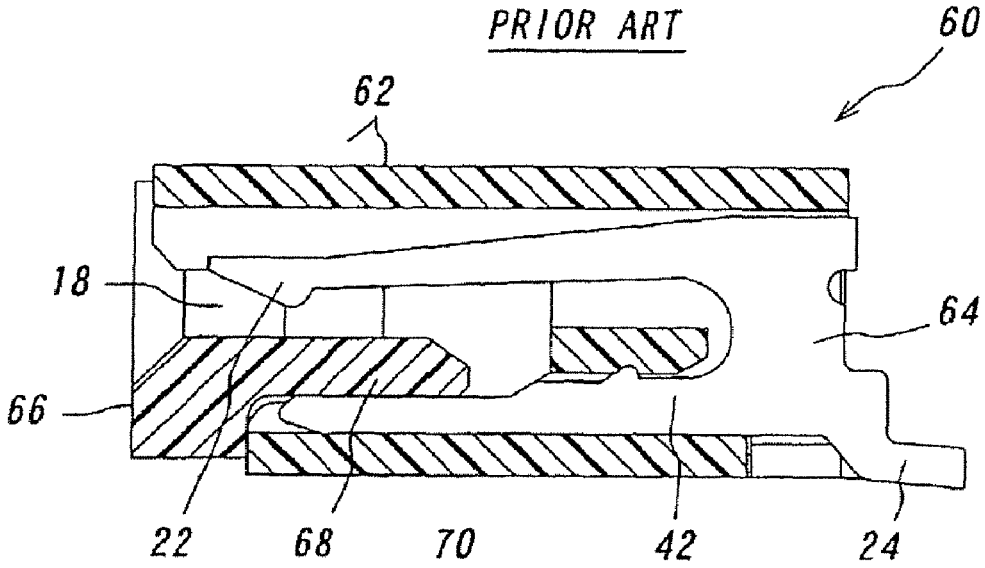
FIG. 30A PRIOR ART
FIG. 30A is a sectional view of the connector of the prior art cut away along a contact before the slider is inserted.
Figure 30B:
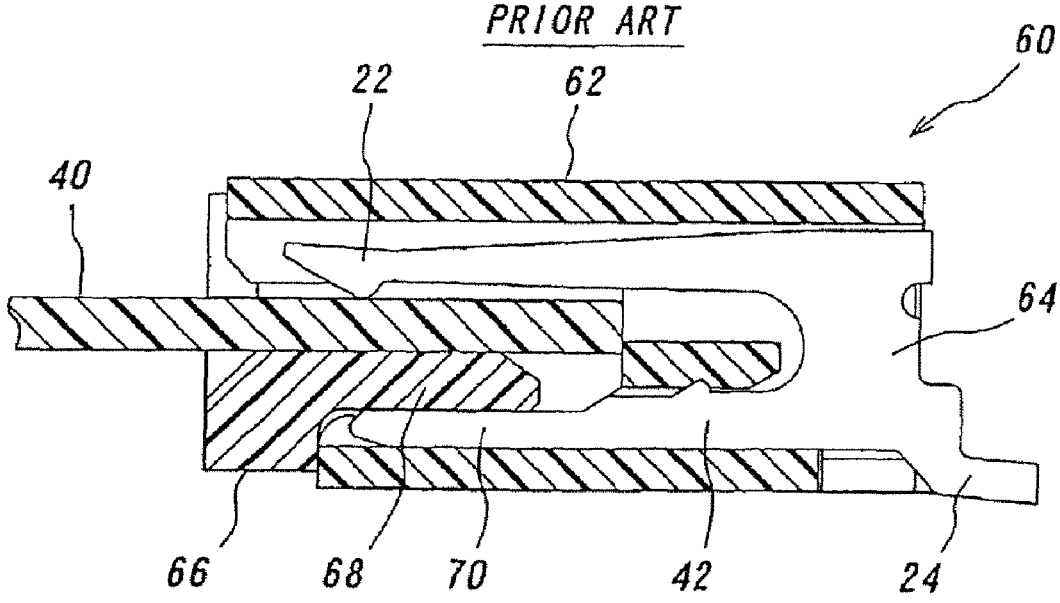
FIG. 30B PRIOR ART
FIG. 30B is a sectional view of the connector of the prior art cut away along the contact with a flexible printed circuit board and the slider inserted.

The plate-shaped piece 544 or 546 may be formed in any shape insofar as it can perform its function. For example, it may be a rectangular thin plate as shown in FIG. 28A. The plate-shaped piece 544 or 546 may have a function other than those described above. For example, as shown in FIGS. 26A and 28B the plate-shaped piece extends with its both ends from the longitudinal ends of the connector 510 so that the extending portions of the plate-shaped piece are fixed to a flexible printed circuit board or substrate as by soldering to be used as fixing means for the connector.

The housing 512 in this embodiment is formed with insertion grooves 538 at required positions for fitting a required number of the contacts 514. The housing 512 will not be described in further detail, because it is substantially the same in construction as the housing 12 in the first aspect of the invention.

Then the contacts 514 will be explained. The contact 514 is substantially "h-shaped" shown in FIG. 27A and mainly composed of a contact portion 522 adapted to contact a flexible printed circuit board 540 or flat cable, a connection portion 524 to be connected to a board or substrate, a fixed portion 542 to be fixed to the housing 512, an elastic portion 534 and a fulcrum portion 532 provided between the contact portion 522 and the connection portion 524, and a pressure receiving portion 520 positioned in opposition to the connection portion 524 and extending from the elastic portion 534. The contact portion 522, the elastic portion 534, the fulcrum portion 532 and the connection portion 524 are arranged in the form of a crank. The contact portion 522 is formed in a projection shape to facilitate the contacting with the flexible printed circuit board 540 or flat cable. The connection portion 524 is of a surface mounting type (SMT) in the shown embodiment, but it may be of a dip type.

The contact portions 522 of the contacts 514 are brought into contact with the flexible printed circuit board 540 or flat cable by the action of the pressure receiving portions 520 raised by the pivotal movement of the slider 516. Projections 526 are provided at the distal ends of the pressure receiving portions 520 of the contacts 514 to prevent the slider 516 from being deformed due to reaction against the pivotal movement of the slider 516. These functions are quite the same as those in the previous embodiments described above.

When the flexible printed circuit board 540 or flat cable is inserted through the insertion opening 518 into the housing 512, the circuited board 540 or flat cable is urged downwardly by the contact portions 522 of the contacts 514 so that the stable and reliable connection between the contacts 514 and the circuited board 540 or flat cable with the aid of the reaction force of the housing 512.

The slider 516 is substantially the same in construction as the slider 16 in the first aspect of the invention and therefore the slider 516 will not be described in further detail.

In the above description, there has been mainly described about the connectors of the first construction mentioned at the beginning of "description of the preferred embodiments" in the specification. However, even the connectors of the second construction (zero-insertion force type) and the third construction (non-zero-insertion force type) may be suitably designed based on the respective characterized features of the first to sixth aspects of the invention and taking care of the above descriptions.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A connector adapted to be detachably fitted with a flexible printed circuit board or flexible flat cable, including a required number of contacts each having at least one contact portion adapted to contact said flexible printed circuit board or flexible flat cable, and a housing holding and fixing said contacts therein and having an insertion opening through which said flexible printed circuit board or flexible flat cable is inserted into said housing, wherein when said flexible printed circuit board or flexible flat cable has contact portions on both its surfaces, said contacts consist of two kinds, each of said contacts of said first kind are arranged in said housing by inserting thereinto from opposite sides of said insertion opening of said housing so that said contact portions of said contacts of said first kind are arranged in said housing by inserting thereinto from one side of the insertion opening and are brought into contact with the contact portions on the one surface of said flexible printed circuit board or flexible flat cable and the contacts of said second kind are arranged in said housing by inserting thereinto from the opposite side of said insertion opening of said housing so that said contact portions of said contacts of said second kind are brought into contact with the contact portions on the other surface of said flexible printed circuit board or flexible flat cable.

2. The connector as set forth in claim 1 wherein said contacts of the two kinds are arranged in pairs each consisting of the different kind contacts so that the contact portions of one pair of contacts are in opposition to each other to embrace said flexible printed circuit board or flexible flat cable therebetween.

3. The connector as set forth in claim 2 wherein the contact portions of each pair of the contacts are staggered relative to each other in the direction of rows of the contacts, when the contact portions of said flexible printed circuit board or flexible flat cable are arranged staggered.

4. The connector as set forth in claim 3 wherein said housing further comprises a recessed portion on the side of said insertion opening for conducting said flexible printed circuit board or flexible flat cable into said housing, and said contacts of said second kind are arranged so as not to permit the connection portions to extend from the recessed portion of said housing.

5. The connector as set forth in claim 4 wherein said connector further comprises a rotary slider which functions to urge said contacts against said flexible printed circuit board or flexible flat cable after said flexible printed circuit board or flexible flat cable has been inserted into said housing, with a view to obtaining a zero-insertion force structure in which no force is applied onto the flexible printed circuit board or flexible flat cable when it is being inserted into the insertion opening of said housing.

6. The connector as set forth in claim 5 wherein each of said contacts of said first kind comprises a connection portion, and an elastic portion and a fulcrum portion provided between said contact portion and said connection portion, and a pressure receiving portion positioned in opposition to said connection portion and extending from said elastic portion so that said contact portion, said elastic portion, said fulcrum portion and said connection portion are arranged substantially in the form of a crank, and each of said contacts of said second kind comprises the contact portion and the connection portion and is so arranged that the contact portion is located in said recessed portion of said housing, and wherein said rotary slider comprises urging portions arranged side by side in its longitudinal direction and is mounted in said housing such that said urging portions are able to be pivotally moved between said connection portions or housing and said pressure receiving portions of the contacts of said first kind.

7. A connector adapted to be detachably fitted with a flexible printed circuit board or flexible flat cable, including a required number of contacts each having at least one contact portion adapted to contact said flexible printed circuit board or flexible flat cable, and a housing holding and fixing said contacts therein and having an insertion opening through which said flexible printed circuit board or flexible flat cable is inserted into said housing, wherein said flexible printed circuit board or flexible flat cable has contact portions on both its surfaces, wherein said contacts consist of two kinds, said contacts of each of the two kinds are inserted into said housing from different ones of the sides of the insertion opening and arranged therein to embrace said flexible printed circuit board or flexible flat cable therebetween, each of said contacts of said first kind is substantially "h-shaped"and comprises a contact portion adapted to contact said flexible printed circuit board or flexible flat cable, a connection portion to be connected to a board or substrate, and an elastic portion and a fulcrum portion provided between said contact portion and said connection portion, and a pressure receiving portion positioned in opposition to said connection portion and extending from said elastic portion, so that said contact portion, said elastic portion, said fulcrum portion and said connection portion are arranged substantially in the form of a crank, each of said contacts of said second kind is substantially I-shaped and comprises a contact portion adapted to contact said flexible printed circuit board or flexible flat cable, and a connection portion to be connected to a board or substrate, the connector further comprising a rotary slider with urging portions for urging said contacts of said first kind of said pressure receiving portion by rotating between said pressure receiving portions and said connection portions, wherein each of said contact portions located on both surfaces of said flexible printed circuit board or flexible flat cable are embraced between corresponding pair of contact portion on a pair of contacts of the two kinds.

8. The connector as claimed in claim 7, wherein each contact of said first and second contact comprises a fixed portion to fix respective contact with said housing.

9. The connector as claimed in claim 7, wherein the pressure receiving portion of each of said contacts of said first kind comprises a projection at its remote end in order to securely engage with said urging portion of said rotary slider.

10. The connector as claimed in claim 8, wherein the pressure receiving portion of each of said contacts of said first kind comprises a projection at its remote end in order to securely engage with said urging portion of said rotary slider.

11. The connector as claimed in claim 7, wherein said flexible printed circuit board or flexible flat cable comprises the contact portion in staggered positions, the each pair of said two kinds of contacts are further having two types having said contact portions to meet with said staggered position of said contact portions of the flexible flat cable or flexible flat cable, and said pair of two kind contacts are arranged in the housing in staggered position to meet positions of contact portions of the mating subject.

12. The connector as claimed in claim 8, wherein said flexible printed circuit board or flexible flat cable comprises the contact portion in staggered positions, the each pair of said two kinds of contacts are further having two types having said contact portions to meet with said staggered position of said contact portions of the flexible flat cable or flexible flat cable, and said pair of two kind contacts are arranged in the housing in staggered position to meet positions of contact portions of the mating subject.

* * * * *